US007794034B2

(12) United States Patent
Shingyohuchi et al.

(10) Patent No.: US 7,794,034 B2
(45) Date of Patent: Sep. 14, 2010

(54) IMAGE FORMATION APPARATUS

(75) Inventors: Mitsuru Shingyohuchi, Kanagawa (JP); Mikio Ohashi, Kanagawa (JP); Hiroshi Noda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 191 days.

(21) Appl. No.: 10/561,303

(22) PCT Filed: Jun. 21, 2004

(86) PCT No.: PCT/JP2004/009040

§ 371 (c)(1),
(2), (4) Date: Dec. 19, 2005

(87) PCT Pub. No.: WO2005/000589

PCT Pub. Date: Jan. 6, 2005

(65) Prior Publication Data

US 2007/0097163 A1 May 3, 2007

(30) Foreign Application Priority Data

Jun. 26, 2003 (JP) ..... 2003-183158

(51) Int. Cl.
*B41J 29/38* (2006.01)

(52) U.S. Cl. ..... 347/11; 347/15; 347/9; 347/10; 347/68

(58) Field of Classification Search ..... 347/9–11, 347/20, 15, 68
See application file for complete search history.

(56) References Cited

U.S. PATENT DOCUMENTS 6,086,189 A 7/2000 Hosono et al.
6,254,213 B1 * 7/2001 Ishikawa ..... 347/10
6,488,349 B1 * 12/2002 Matsuo et al. ..... 347/11
2003/0001912 A1 * 1/2003 Kusunoki ..... 347/11
2003/0067500 A1 4/2003 Fujimura et al.
2003/0122888 A1 7/2003 Baba et al.
2004/0207671 A1 * 10/2004 Kusunoki et al. ..... 347/10

FOREIGN PATENT DOCUMENTS

| | | |
|---|---|---|
| EP | 1270224 A2 | 1/2003 |
| JP | 4-15735 | 3/1992 |
| JP | 9-52360 | 2/1997 |
| JP | 10-81012 | 3/1998 |
| JP | 11-20165 | 1/1999 |
| JP | 11-277744 | 10/1999 |
| JP | 2000-15802 | 1/2000 |

(Continued)

OTHER PUBLICATIONS

Dec. 23, 2008 search report in connection with a counterpart European patent application No. 04 74 6509.

*Primary Examiner*—Matthew Luu
*Assistant Examiner*—Henok Legesse
(74) *Attorney, Agent, or Firm*—Cooper & Dunham LLP

(57) ABSTRACT

An image formation apparatus is disclosed, wherein a time interval between a first ink drop and a second ink drop is set at 1.5×Tc, a time interval between the second ink drop and a third ink drop is set at 1.5×Tc, and a time interval between the third ink drop and a fourth ink drop is set at 2×Tc, where Tc represents the specific vibration cycle of a pressurized ink chamber.

18 Claims, 23 Drawing Sheets

FOREIGN PATENT DOCUMENTS

| | | |
|---|---|---|
| JP | 2000-15803 | 1/2000 |
| JP | 2000-43245 | 2/2000 |
| JP | 2000-263775 | 9/2000 |
| JP | 2001-10035 | 1/2001 |
| JP | 2001-301207 | 10/2001 |
| JP | 2002-86765 | 3/2002 |
| JP | 2002-219800 | 8/2002 |
| JP | 2003-19793 | 1/2003 |
| JP | 2003-19805 | 1/2003 |
| JP | 2003-94649 | 4/2003 |
| JP | 2003-154689 | 5/2003 |
| JP | 2003-175599 | 6/2003 |
| JP | 2003-175601 | 6/2003 |
| WO | WO01/21408 | 3/2001 |

* cited by examiner

IMAGE FORMATION APPARATUS

TECHNICAL FIELD

The present disclosure generally relates to an image formation apparatus, and more particularly relates to an image formation apparatus equipped with an ink drop discharging head.

BACKGROUND ART

[Patent reference 1] JP, 4-15735, B

[Patent reference 2] JP, 10-81012, A

An ink jet head for discharging an ink drop is used by an ink jet recording device serving image formation apparatuses, such as printers, facsimile apparatuses, copiers, and plotters. As the ink jet head, products based on various technologies have been available, such as a piezo type product wherein an ink drop is discharged by deforming a diaphragm that constitutes a partition of an ink passage (pressurized ink chamber) by a piezoelectric device serving as pressure generating means for generating pressure for pressurizing ink in the ink passage such that the volume of the ink chamber is changed, a thermal type product wherein an ink drop is discharged by generating air bubbles by heating the ink in the pressurized ink chamber using an exothermic resistor, and an electrostatic product wherein an ink drop is discharged by changing the volume of the pressurized ink chamber by deforming a diaphragm by an electrostatic force applied between the diaphragm and an electrode that opposes the diaphragm.

For driving the ink jet head, there are two methods. Namely, one is called a "push and strike" method whereby an ink drop is discharged by reducing the volume of the pressurized ink chamber by pushing the diaphragm toward the pressurized ink chamber, and a "pull and strike" method whereby an ink drop is discharged when the diaphragm that is first pulled out is made to return to its original position.

Further, a method of forming a large ink drop is disclosed by Patent reference 1 wherein two or more minute ink drops, i.e., ink droplets, are sequentially discharged, and the ink droplets merge before reaching a recording medium (paper form) to form a large ink drop.

In addition, an apparatus that is capable of gradation printing is disclosed by Patent reference 2 wherein a first drive pulse discharges a first ink drop, and a second drive pulse discharges a second ink drop, dimensions of which are different from the first ink drop; and more than four gradation steps are made available by combining the first and the second drive pulses.

Problem(s) to be Solved by the Invention

Generally, large ink drops are used to print a wide area, and small ink drops are used to print a fine pattern. Accordingly, the large ink drops need to contain sufficient ink volume that is a function of the resolution defined by the pitch of nozzles and the number of nozzle columns. For example, two nozzle columns for the same color having a nozzle pitch of 150 dpi provide a 300 dpi resolution. If the ink volume of the large ink drops is not sufficiently great, the wide area may not be fully printed, leaving white spots in the nozzle column directions (sub-scanning directions). This requires interlacing, which slows down the printing speed.

If the nozzle pitch is made finer, less ink drop volume may be sufficient. However, this poses problems, such as there being a limit in reducing the nozzle pitch due to available process precision, the printing speed becoming slower unless the number of nozzles increases, and the cost increased due to the increased number of channels of control IC for controlling the increased number of nozzles.

For this reason, the volume of ink needed for large ink drops is still great. On the other hand, the small ink drops are required to be smaller for realizing a finer pattern to be printed. That is, the ratio of the ink drop volume Mj of the large ink drop to that of the small ink drop is increasing, and accordingly, it is required that the large ink drops and the small ink drops be distinctively controlled.

In order to solve the problems as mentioned above, the method for merging small ink drops before reaching the target medium (paper form) for obtaining a large ink drop as disclosed by [Patent reference 1] is desired to be improved such that the volume of the small ink drops can be reduced, and the number of the small ink drops for forming a large ink drop can be increased.

In addition, in order for the large ink drop to spread in the sub-scanning directions, the small ink drops need to be merged before reaching the target medium (paper form), which requires that the small ink drops be discharged at short intervals such as microseconds. For example, if the gap between the nozzle and the recording medium (paper form) is set at about 1 mm, and the speed of the ink drops Vj is considered to range between 5 and 10+ m/s, as usually practiced, the ink drops reach the target medium (paper form) in 100-200 μs.

In this time interval, pressure vibration of the pressurized ink chamber due to discharging a preceding ink drop is not sufficiently damped. For this reason, the frequency at which ink drops are sequentially discharged needs to be at a proper timing in reference to vibration of the pressurized ink chamber.

Here, the timing dependence when two ink drops are discharged is explained with reference to FIG. 39 and FIG. 40, wherein a piezoelectric device (piezoelectric vibrator) that displaces in d33 directions constitutes a head.

FIG. 39 shows a drive pulse for discharging the two ink drops, the drive pulse containing two drive pulses P501 and P502. In the case of the head using the piezoelectric device (piezoelectric vibrator) displacing in the d33 directions as mentioned above, an ink drop is discharged when the pressurized ink chamber is contracted by a wave element P501*a* (rising inclination identified by an arrow) and a wave element P502*a* (rising inclination identified by an arrow) that are rising edges of the drive pulses P501 and P502, respectively.

FIG. 40 shows an example of measurements of the ink drop speed Vj and the ink drop volume Mj, when a time interval Td of the ink discharge (discharge interval) between the two drive pulses P501 and P502 is varied. Here, the ink drop speed Vj is obtained based on the time from the discharge of the first ink drop to the arrival of the first ink drop at the target medium (paper form) that is 1 mm far. For this reason, the ink drop speed Vj when used for the second ink drop is slightly lower than actual. Further, plotted points that are shown only by black triangles (i.e., white triangles are not associated) indicate that the ink drop speed Vj of the first ink drop and the second ink drop are the same, and the second ink drop is merged with the first ink drop (the two ink drops have coalesced). Furthermore, the ink drop volume Mj is obtained from the total of ink consumption after ink drops discharge for a given number of times, and is the sum of the first ink drop and the second ink drop in this example.

As seen from FIG. 40, in the cases of Td=8 and Td=12 wherein the properties (Vj and Mj) have a steep inclination, the ink drop speed Vj and the ink drop volume Mj tend to greatly change when the vibration frequency slightly shifts due to external factors, such as variation of the head, temperature, and negative pressure, which change is not a desirable result. On the other hand, when Td is near 10, pressures mutually cancel out, and the ink drop speed Vj tends to become low, which undesirably causes the second ink drop to be unable to merge with the first ink drop.

That is, it is desirable to discharge ink drops at the timing where the pressures are in sync (peak timing).

However, as the number of ink drops that are to merge is increased, and the ink drops are sequentially discharged at the peak timing, the pressurized ink chamber is violently excited in terms of vibration. The vibration, i.e., residual vibration, causes additional and unwanted ink to be discharged. Since the additional ink is discharged with inappropriate pressure, the discharge is imperfect, causing the surface of the nozzle to become soiled. When the nozzle surface is soiled, direction of ink injection can to be bent (deflected from straight down), the nozzle may become clogged and incapable of squirting, the ink drop speed Vj may be decreased, and the discharge may be not make a drop but become a mist, resulting in poor printing.

To cope with this, i.e., in order that the residual pressure does not cause the discharge of additional and unwanted ink, it is often practiced that the driver voltage is lowered. However, when the number of ink drops increases, the voltage margin within which discharge can be stably carried out becomes narrow. That is, lowering the voltage is not always an answer.

SUMMARY

In an aspect of the present disclosure, an image formation apparatus is provided that can print a high-definition image at high speed, wherein the ink drop volume Mj is able to be varied over a wide range, while ink drop discharging is stably carried out.

In another aspect of this disclosure, an image formation apparatus is provided that includes a structure for sequentially discharging a predetermined number of ink drops, wherein at least one ink drop other than the last ink drop of the multiple ink drops is discharged after its preceding ink drop at an interval of about $(n+1/2)\times Tc$, where n is an integer equal to or greater than 1, and Tc represents resonance cycle of a pressurized ink chamber.

To achieve these and other advantages and in accordance with the purpose of the invention, as embodied and broadly described herein, the invention provides as follows.

Means for Solving the Problem

The image formation apparatus according to the present invention that solves the above problems includes a structure for sequentially discharging a predetermined number of ink drops, wherein at least one ink drop other than the last ink drop of the multiple ink drops is discharged after its preceding ink drop at an interval of about $(n+1/2)\times Tc$, where n is an integer equal to or greater than 1, and Tc represents resonance cycle of a pressurized ink chamber.

Here, it is desirable that n be set at 1 (n=1), i.e., the interval be set at $1.5\times Tc$. Further, as for ink drops other than one or more ink drops that are discharged at the intervals of $(n+1/2)\times Tc$ after their respective preceding ink drops, they are desirably discharged at an interval of about $n\times Tc$ after their respective preceding ink drops.

Further, the first ink drop is desirably discharged by contracting, but without first expanding, the pressurized ink chamber, or alternatively, by contracting the pressurized ink chamber by a volume greater than a first expanding volume. In this case, it is desirable that the second ink drop be discharged at the interval of about $(n+1/2)\times Tc$ after the first ink drop. The ink drop speed Vj is calculated by the time duration of a discharged ink drop reaching the target medium (paper form), which distance is set to be 1 mm, assuming that there are no more ink drops following.

Furthermore, the ink drop speed Vj of ink drops discharged at intervals of about $(n+1/2)\times Tc$ after respective preceding ink drops is desirably set to be greater than 3 m/s, at which speed sequential ink drops are able to merge.

Furthermore, it is desirable that four or more ink drops merge to form one ink drop during flight from the nozzle to the target medium.

Further, it is desirable that the drive pulse include a waveform for suppressing the residual vibration after the drive pulse for discharging the last ink drop. In this case, the waveform for suppressing the residual vibration is desirably shaped such that the vibration is damped within the resonance cycle Tc after discharging the last ink drop.

Furthermore, it is desirable that a selected part(s) of the drive pulse for forming a large ink drop be capable of forming a small-sized ink drop and a medium-sized ink drop. Further, it is desirable that the drive pulse include a waveform that vibrates a meniscus, yet without making an ink drop discharge. Further, it is desirable that there be an interval wherein a voltage is applied to pressure generating means even if a given channel does not discharge an ink drop in a given printing cycle. In this case, it is desirable that the pressure generating means be a piezoelectric device, and the piezoelectric device be recharged during the interval where the above-mentioned voltage is applied.

Here, a piezoelectric device, the displacement direction of which is d33, can serve as the pressure generating means. Further, support sections of the piezoelectric device, which support sections correspond to partitions of the pressurized ink chambers, can be a part of the piezoelectric device.

DESCRIPTION OF EXEMPLARY EMBODIMENTS

Examples and exemplary embodiments of the present invention are described below with reference to the accompanying drawings. Features and advantages of the present invention become apparent from the description and the accompanying drawings.

Figure 1:
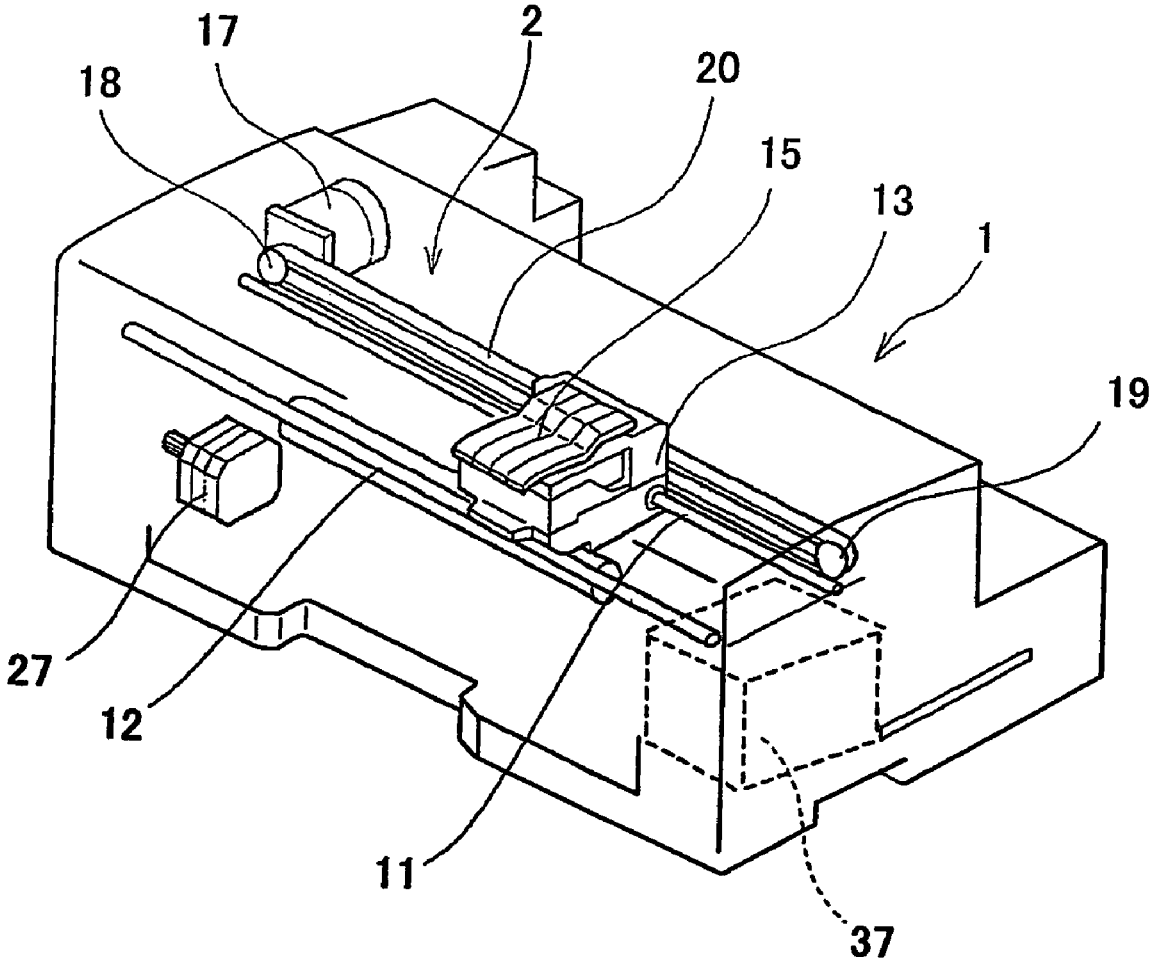
FIG. 1 is a perspective diagram showing an example of a mechanism section of an ink jet recording device serving as an image formation apparatus of the present invention.
Figure 2:
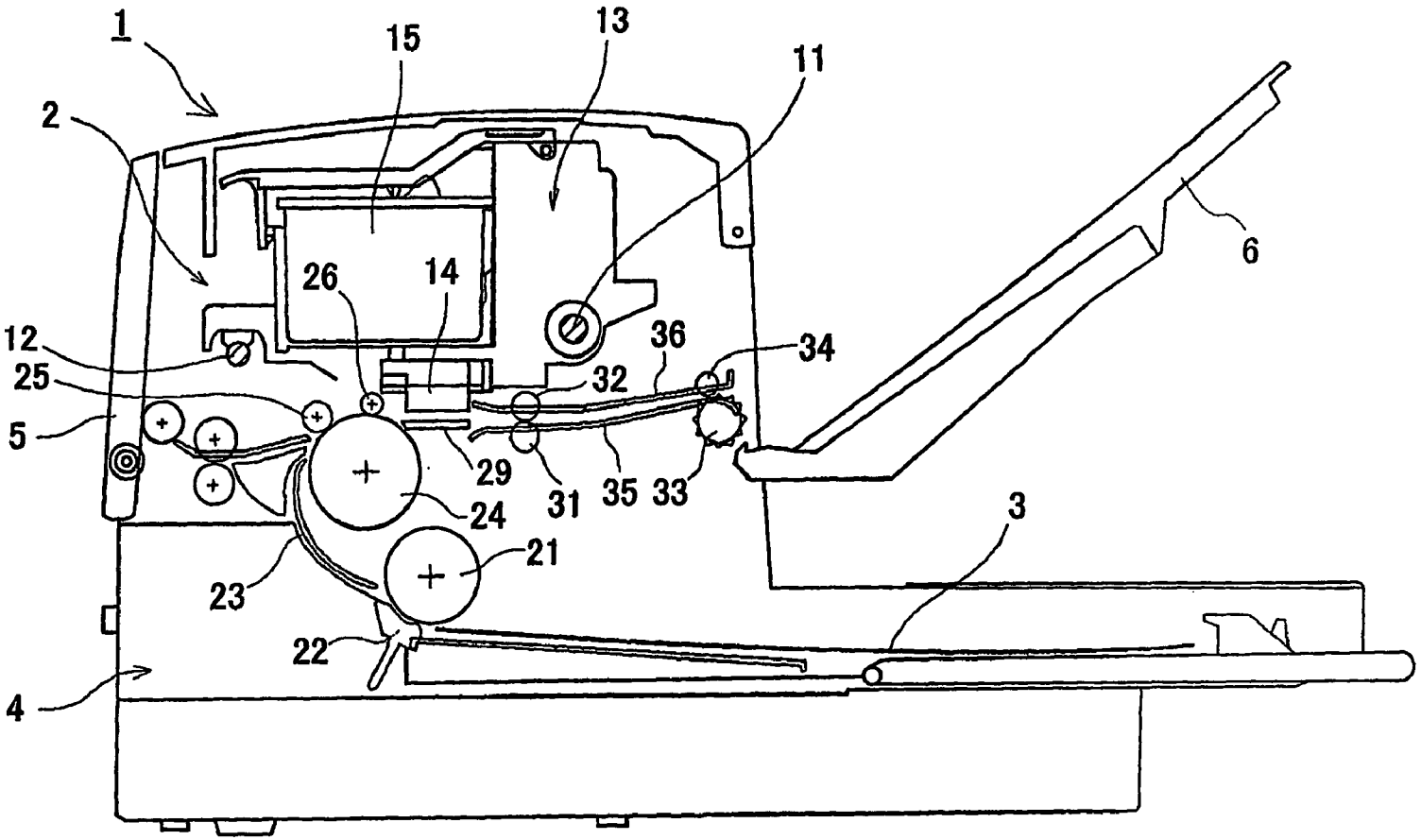
FIG. 2 is a side view of the mechanism section of the ink jet recording device.

FIG. 1 is a perspective diagram showing a mechanism section of an ink jet recording device serving as an image formation apparatus of the present invention. FIG. 2 is a side view of the mechanism section of the ink jet recording device.

The ink jet recording device includes a recording device main part 1 that includes a printing mechanism unit 2 that further includes a carriage 13 that is movable in the main scanning direction, one or more ink jet heads 14 mounted to the carriage 13, and one or more ink cartridges 15 for supplying ink to the ink jet heads 14. The ink jet recording device further includes a feed cassette 4, and optionally includes a hand feeding tray 5, for supplying a recording medium (paper form) 3 such that a desired image is printed thereon by the printing mechanism unit 2, and a delivery tray 6 provided on the rear side of the ink jet recording device for delivering the recording medium 3.

The printing mechanism unit 2 includes a main guide rod 11 and a sub-guide rod 12, both serving as a guiding member prepared horizontally across side plates provided (not illustrated) on the right and left sides, the guiding member supporting the carriage 13 so as to be sliding-free in the main scanning direction (i.e., perpendicular to the paper of FIG. 2). Each of the ink jet heads 14 discharges one of yellow (Y), cyan (C), magenta (M), and black (Bk) inks, with the direction of ink drop discharge being set downward. The ink cartridges 15 are provided in the upper part of the carriage 13 for supplying respective inks to the ink jet heads 14, the ink cartridges 15 being replaceable.

Each of the ink cartridges 15 includes an atmospheric mouth prepared at the upper part for free passage of the air, an ink supply mouth prepared at the bottom part for supplying ink, and a porous material-containing object that is filled up with ink wherein the ink to be supplied to the ink jet head 14 is maintained at a slightly negative pressure by the capillary tube action of the porous material. Ink is supplied to the ink jet heads 14 from respective ink cartridges 15.

As briefly described above, the carriage 13 is installed sliding-free with its rear side inserted into the main guide rod 11, the rear side being on the down stream side of the recording medium 3 (paper form) being conveyed, and with its front side being placed on the sub-guide rod 12, the front side being on the upper stream side of the recording medium 3 being conveyed. In order to move the carriage 13 for scanning in the main scanning direction, a timing belt 20 is installed between a drive pulley 18 and a follower pulley 19 that are driven by a main scanning motor 17. The timing belt 20 is fixed to the carriage 13 such that the carriage 13 moves to and fro as the rotation of the main scanning motor 17 is reversed.

Further, although one of the ink jet heads 14 is provided as the recording head for each color here, one head having multiple nozzles for discharging ink drops in each color can also be used. In the present embodiment, piezoelectric type ink jet heads are used as the ink jet heads 14, each of which includes a diaphragm that forms at least a part of the surface of an ink passage partition, wherein a piezoelectric device deforms the diaphragm.

In order to convey the recording medium (paper form) 3 set to the feed cassette 4 to the lower part side of the head 14, the printing mechanism unit 2 includes a feed roller 21 and a friction pad 22 for separating and feeding a sheet of the paper form 3 from the feed cassette 4, a guide member 23 for guiding the paper form 3, a conveyance roller 24 for conveying the paper form 3 in the reverse direction, a conveyance pinch roller 25 pushed to the circumference of the conveyance roller 24, a tip pinch roller 26 for defining the conveyance angle of the paper form 3 conveyed by the conveyance roller 24, and a sub-scanning motor 27 for rotating the conveyance roller 24 through a gear sequence.

The printing mechanism unit 2 further includes a paper form receiving member 29 for guiding the paper form 3 conveyed by the conveyance roller 24 corresponding to the moving range in the main scanning direction of the carriage 13 at the lower part of the ink jet heads 14. The printing mechanism unit 2 further includes the following items on the downstream side of the paper form conveyance of the paper form receiving member 29, namely, a conveyance pinch roller 31 and a spur 32 that rotate for conveying the paper form 3 in the delivery direction, a delivery roller 33 and a spur 34 for delivering the paper form 3 to the delivery tray 6, and guide members 35 and 36 for forming a delivery path.

With the configuration as described above, printing a line is carried out by moving the carriage 13 in the main scanning direction, by driving the ink jet heads 14 according to an image signal, and by discharging corresponding inks onto the paper form 3 that is stopped. When printing of the line is completed, the following line is printed after conveying the paper form 3 by a predetermined amount. When one of a print end signal and a signal indicating that the paper form 3 has arrived at a predetermined bottom of the print area is received, printing is terminated and the paper form 3 is delivered.

Further, in a position outside of the printing area on the right-hand side of the moving direction of the carriage 13, a recovery apparatus 37 for recovering from poor discharging of the ink jet heads 14 is arranged. The recovery apparatus 37 is equipped with cap means, suction means, and cleaning means. While the carriage 13 is not being used, it is moved to the recovery apparatus 37, and the capping means caps the ink jet heads 14 such that a moist state of the nozzles is maintained, and poor discharge due to ink dryness is prevented from occurring; and ink that is not related to printing is pumped out (purged) such that ink viscosity of all nozzles is adjusted for obtaining stable discharging performance.

When poor discharging occurs, the capping means seals the nozzle of the ink jet head 14, the suction means evacuates ink, air bubbles, etc., out of the nozzle through a tube, and the cleaning means removes ink, dust, etc., adhering to the nozzle. In this manner, adequate discharging is restored. Further, the evacuated ink is exhausted to an ink disposal tank (not illustrated) installed in the lower part of the main part 2, and an ink absorber arranged in the ink disposal tank absorbs the disposed ink.

Figure 3:
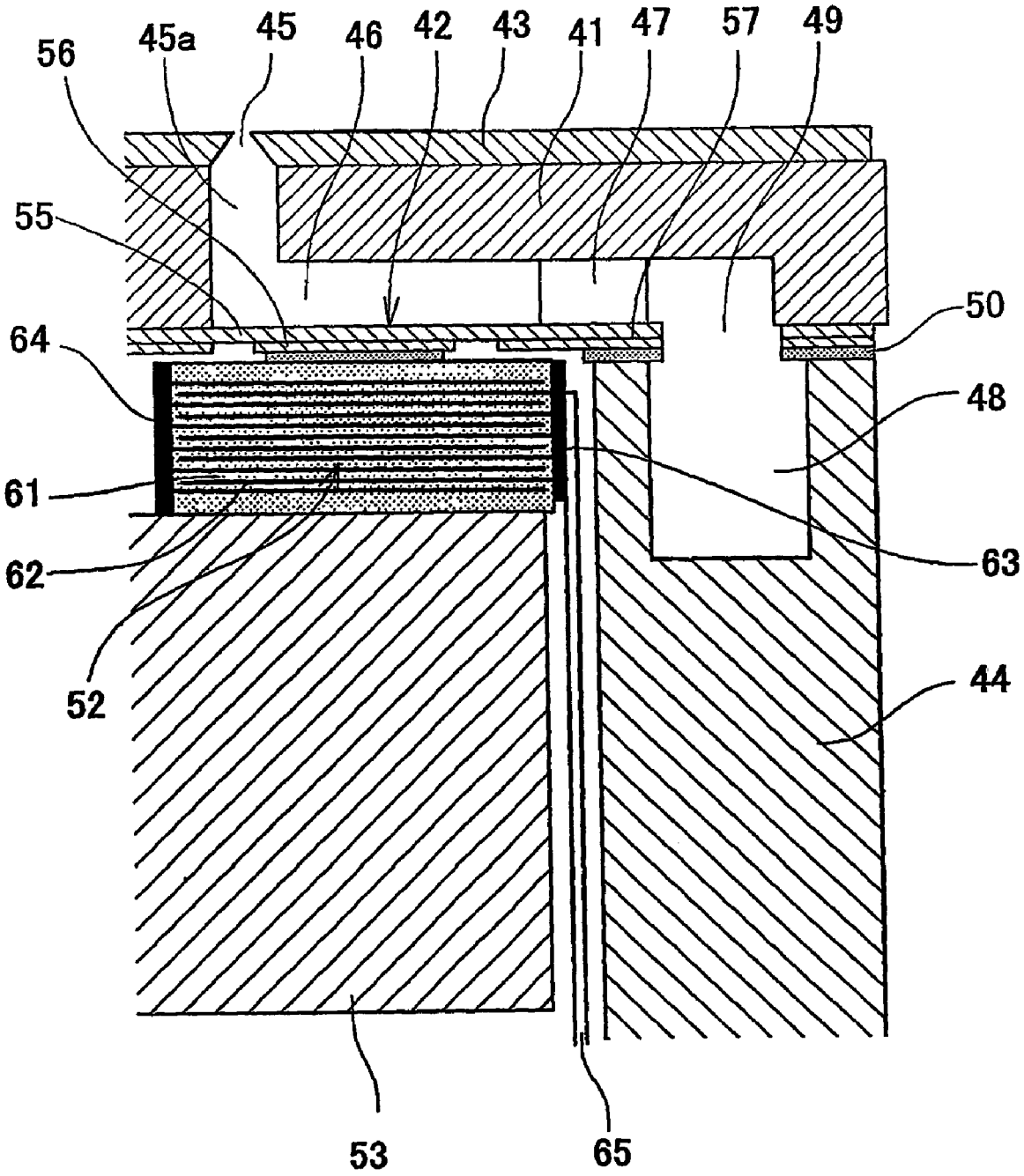
FIG. 3 is a cross-sectional view showing an example of an ink jet head that constitutes a recording head of the recording device taken along the direction of the longer side of a ink chamber.
Figure 4:
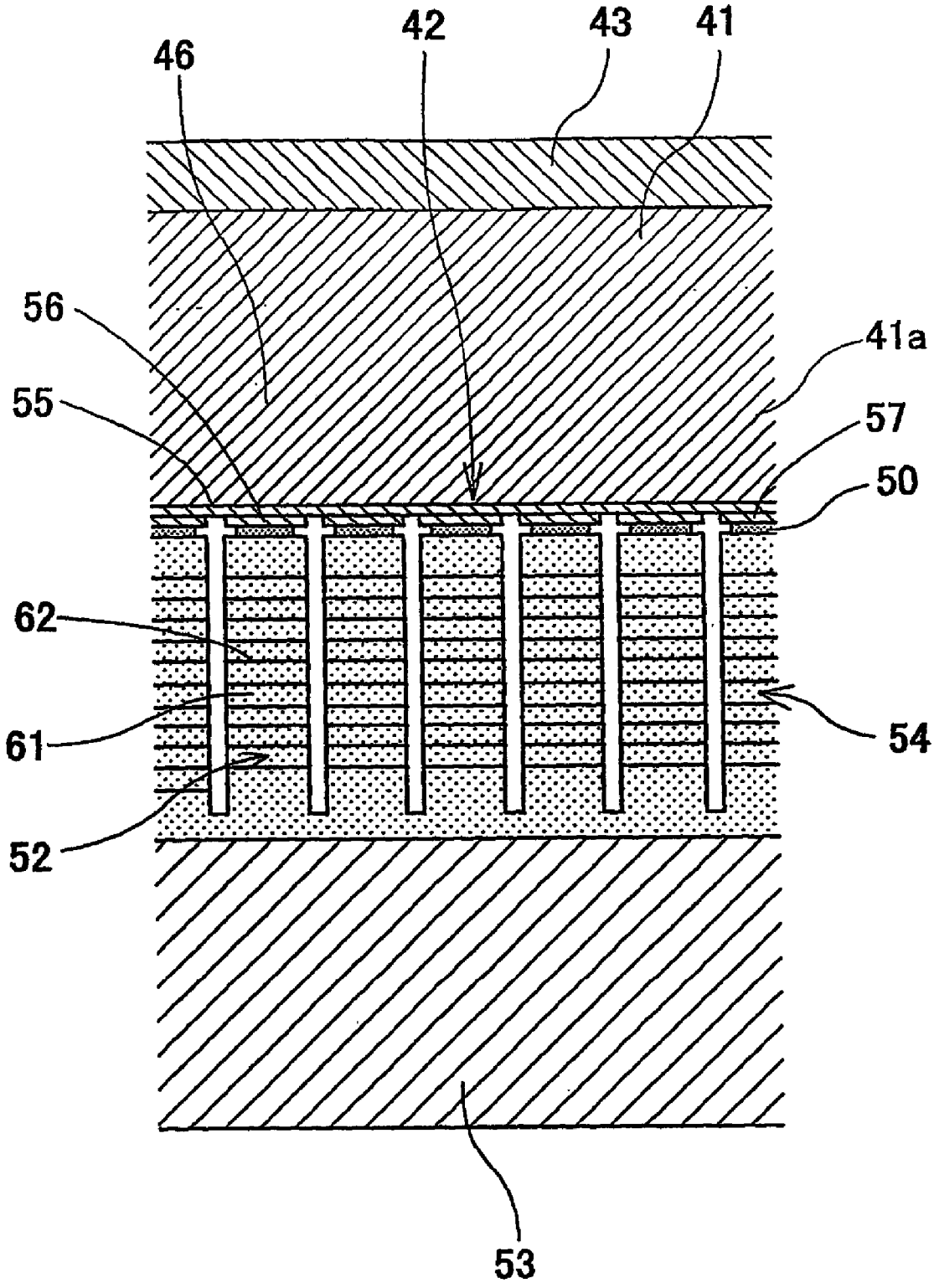
FIG. 4 is a cross-sectional diagram showing the ink jet head taken along the shorter side of the ink chamber.

Next, descriptions follow about the ink jet heads 14 of the ink jet recording device with reference to FIG. 3 and FIG. 4. Here, FIG. 3 is a cross-sectional diagram of the ink jet heads 14 in the longer side direction of the ink chamber, and FIG. 4 is a cross-sectional diagram of the ink chamber of the ink jet heads 14 in the shorter side direction.

The ink jet heads 14 include a passage board 41 formed by a single-crystal-silicon substrate, a diaphragm 42 joined to the undersurface of the passage board 41, and a nozzle plate 43 joined to the upper surface of the passage board 41, which constitute a pressurized ink chamber 46 for forcing the ink through a nozzle passage 45*a* such that a nozzle 45 discharges an ink drop, and an ink supply way 47 serving as a fluid-resistance section for supplying ink to the pressurized ink chamber 46 from a common ink chamber 48 to which the ink is supplied from an ink supply mouth 49.

Further, a laminated type piezoelectric device 52 serving as an electro-mechanical transducer, i.e., pressure generating means (actuator means) for pressurizing the ink in the pressurized ink chamber 46 is provided on the external surface side (the side opposite to the pressurized ink chamber side) of the diaphragm 42 corresponding to each pressurized ink chamber 46. The piezoelectric device 52 is joined to a base substrate 53. Further, in the piezoelectric device 52, support sections 54 are formed corresponding to partition sections 41*a* that separate the pressurized ink chambers 46 (bi-pitch structure). Here, a slit process of half-cut dicing is carried out such that the piezoelectric device is divided like the shape of comb teeth, adjacent teeth alternately serving as the piezoelectric device 52 and the support section 54. Although the support section 54 is materially and structurally the same as the piezoelectric device 52, the difference is that a driver voltage is not applied to the support section 54. In this manner, the support section 54 serves as a mere physical support.

Further, the perimeter of the diaphragm 42 is joined to a frame member 44 with an adhesive 50 that contains gap-filling material. The frame member 44 includes a concavity serving as the common ink chamber 48, and an ink supply hole, which is not illustrated, for supplying ink to the common ink chamber 48 from the exterior. The frame member 44 is formed by injection molding with, for example, epoxy system resin or polyphenylene sulfide.

Here, although the passage board 41 is formed by anisotropic etching of, for example, a single-crystal silicon substrate of a crystal-face direction (110) using an alkaline etching solution, such as potassium-hydroxide solution (KOH), for forming the concavity and the hole section serving as the nozzle passage 45*a*, the pressurized ink chamber 46, and the ink supply way 47, other materials can be used, such as stainless steel substrates, photosensitive resins, etc.

Although the diaphragm 42 is formed, for example, from a metal plate of nickel by an electroforming method, other materials may be used, such as other metal plates, a resin board, combined materials of metal and resin, and the like. The diaphragm 42 constitutes a thin part 55 (diaphragm section) for making deformation easy in the portion corresponding to the pressurized ink chamber 46, and a thick part 56 (in the shape of an island) for joining to the piezoelectric device 52. Further, at the portion corresponding to the support section 54 and the joint section to the frame member 44, a thick part 57 is formed. The flat side of the diaphragm 42 is fixed to the passage board 41 with an adhesive, and the thick part 56 is fixed to the piezoelectric device 52 with an adhesive. The thick part 57 is fixed to the support section 54 and the frame member 44 with adhesives 50. Here, the diaphragm 42 is constituted by a nickel plating layer formed by electroforming, and the like, wherein thickness of the thin part (diaphragm section) 55 is set to 3 μm, and width is set to 35 μm (one side).

The nozzle plate 43 includes the nozzle 45 having a diameter of 10 through 35 μm corresponding to each pressurized ink chamber 46, and adhesively fixed to the passage board 41. As the nozzle plate 43, various materials can be used, such as stainless steel and nickel, combinations of metal and resin such as a polyimide resin film, silicon, and combinations thereof. Here, the nozzle plate 43 is formed by a nickel plating film prepared by the electroforming method, and the like. Further, the internal shape (inner side form) of the nozzle 43 is shaped like a horn (alternatively, a shape near to a cylinder, and a shape near to a right circular cone), and the diameter of the nozzle 45 is set to about 20-35 μm at the ink drop outlet side. Furthermore, the nozzle pitch of each nozzle sequence is set at 150 dpi.

Further, on the nozzle surface (surface in the ink discharging direction) of the nozzle plate 43, a water-repellent finish layer (not illustrated) is prepared. The water-repellent-finish layer can be formed in various manners such as PTFE-nickel eutectoid plating, electro-deposition painting of fluororesin, evaporation-coating of fluororesin with evaporability such as fluoride pitch, and baking after application of a solvent of silicon system resin and fluorine system resin. An adequate water-repellent finish layer is selected depending on physical properties of the ink such that the ink drop formation, and the ink flight property, for example, are stabilized in order obtain high-definition image quality.

The piezoelectric device 52 is constituted by laminating piezo-electric layers 61 of lead zirconate titanate (PZT), the thickness of each layer being 10-50 μm, and internal electrode layers 62 of silver-palladium (AgPd), thickness of each layer being several micrometers, wherein the internal electrodes 62 are electrically connected to individual electrodes 63 and a common electrode 64 alternately. The individual electrodes 63 and the common electrode 64 are terminal electrodes (external electrode) provided on the edges. With the arrangement described above, the pressurized ink chamber 46 is contracted and expanded by expansion and contraction, respectively, of the piezoelectric device 52 having a piezoelectric constant of d33. When a drive pulse is applied to the piezoelectric device 52, the piezoelectric device 52 is charged and expands; when the charge is removed, the piezoelectric device 52 contracts.

The terminal electrodes on a side of the piezoelectric device 52 are divided by a half-cut dicing process to form the individual electrodes 63, while, on the other hand, the terminal electrodes on the other side are not divided, and the common electrode 64 is formed, the common electrode 64 being electrically connected to all the piezoelectric devices 52.

In order to provide a drive pulse to the individual electrodes 63 of the piezoelectric device 52, an FPC cable 65 is connected to the individual electrodes 63 by one of solder junction, ACF (anisotropic conductivity film) junction, and wire bonding, and the other end of the FPC cable 65 is connected to a drive circuit (driver IC) such that the drive pulse is selectively applied to each piezoelectric device 52. Further, the common electrode 64 is connected to the ground (GND) electrode of the FPC cable 65.

According to the ink jet head configured as above, when a drive pulse having a voltage of, for example, 10-50 V is applied to the piezoelectric device 52 according to a print signal, a displacement occurs in the direction of the layers of the piezoelectric device 52, i.e., in the d33 direction according to the present embodiment, the ink in the pressurized ink chamber 46 is pressurized through the diaphragm 42, the pressure of the ink rises, and an ink drop is discharged from the nozzle 45.

Then, with the end of ink discharge, the ink pressure in the pressurized ink chamber 46 decreases, and negative pressure occurs in the pressurized ink chamber 46 due to the inertia of the ink flow and the electric discharge process of the drive pulse, and an ink filling process starts. At this time, the ink supplied from the ink tank which is not illustrated flows into the common ink chamber 48, and passes along the fluid-resistance section 47 through the ink supply mouth 49 from the common ink chamber 48, and the pressurized ink chamber 46 is filled with ink.

In addition, while the fluid-resistance section 47 has an effect in damping of the residual pressure vibration after discharging, it serves as a resistor to refilling due to surface tension. Accordingly, by suitably selecting the fluid-resistance value of the fluid-resistance section 47, the balance between damping of the residual pressure and refill time can be selected so that the drive cycle, i.e., the time between a discharge and the next discharge can be shortened.

Figure 5:
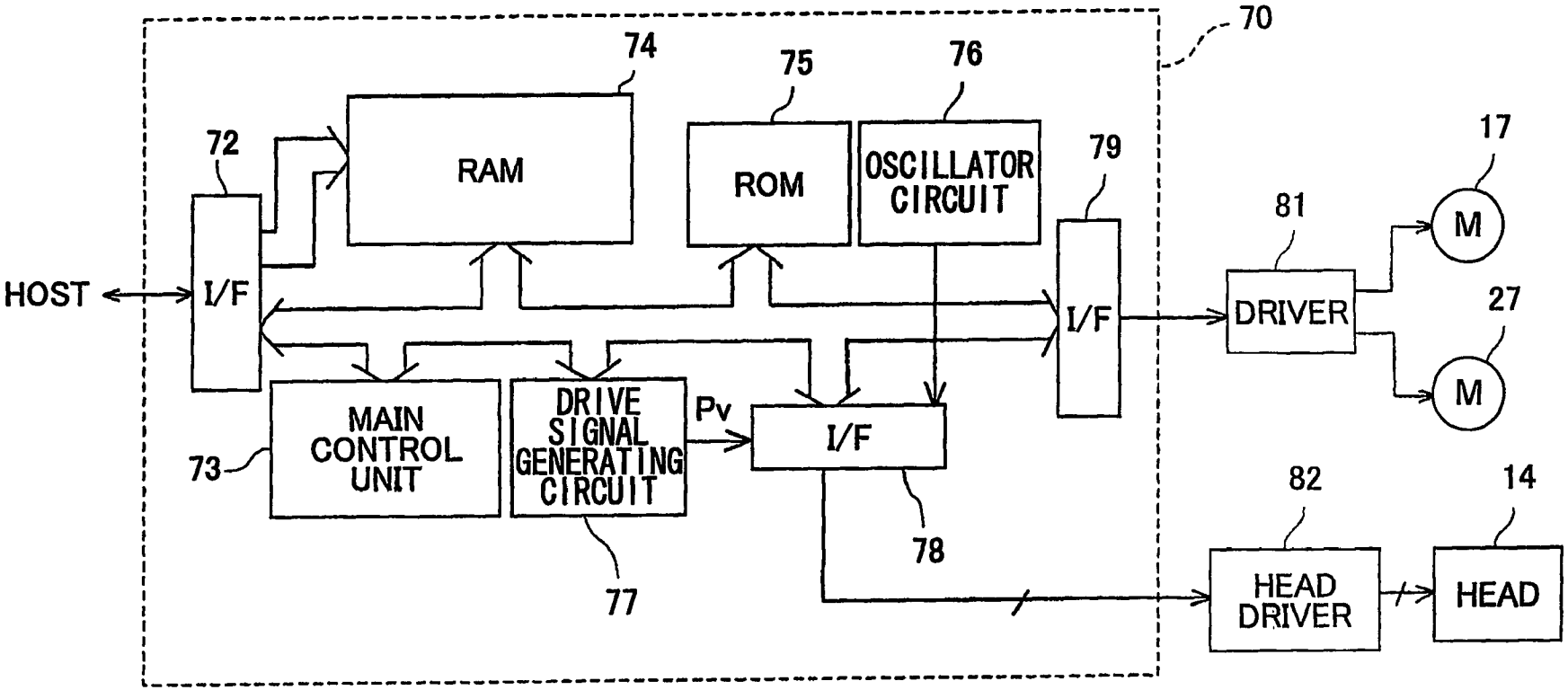
FIG. 5 is a block diagram showing the outline of a control unit of the ink jet recording device.
Figure 6:
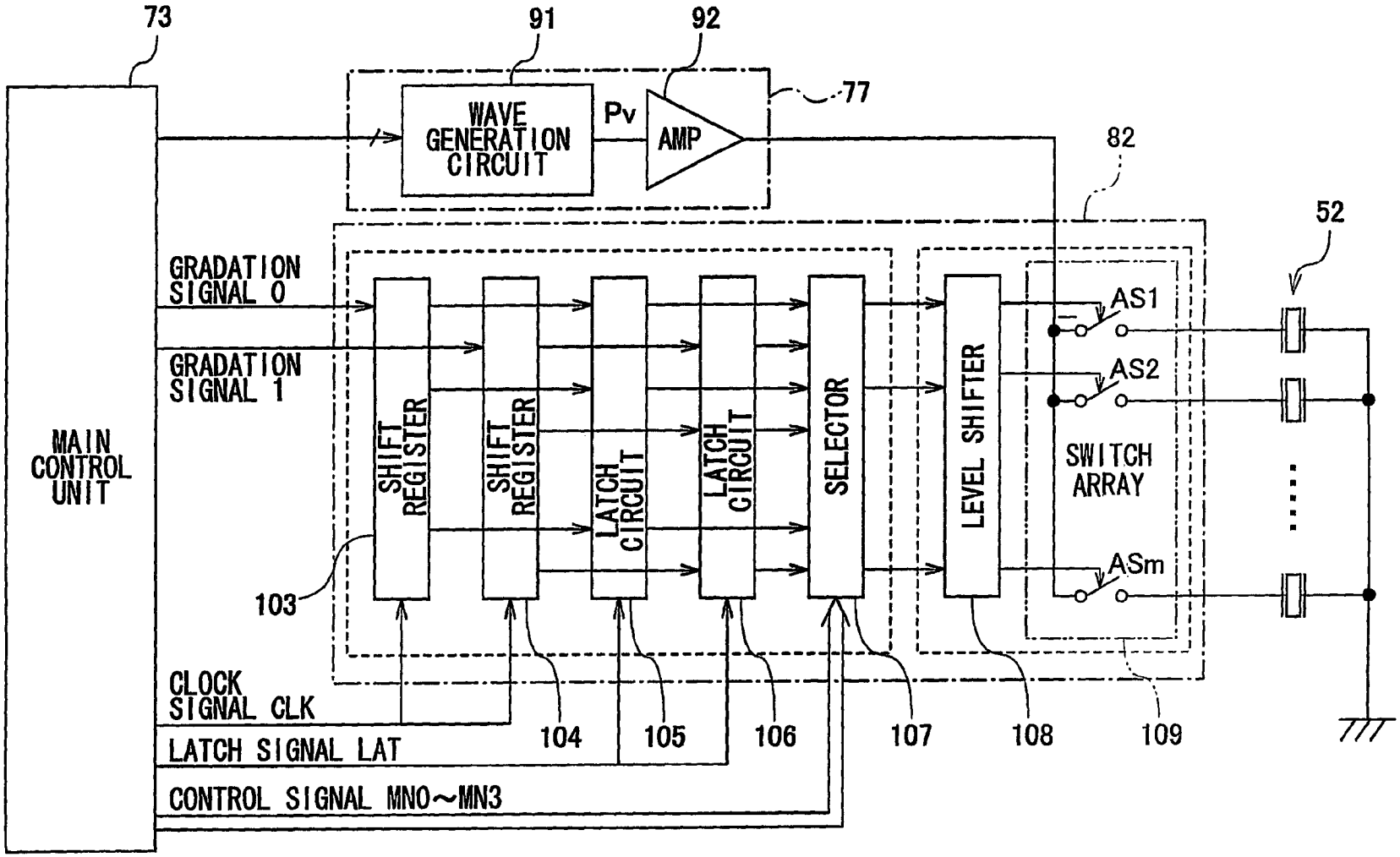
FIG. 6 is a block diagram showing a portion of the control unit concerning drive control of the ink jet head.

Next, an outline of the control unit of the ink jet recording device is explained with reference to FIG. 5 and FIG. 6. Here, FIG. 5 is a block diagram showing the outline of the control unit, and FIG. 6 is a block diagram showing a portion concerning head drive control of the control unit.

The control unit includes a printer controller 70, a motor driver 81 for driving the main scanning motor 17 and the sub-scanning motor 27, and a head driver 82 for driving the ink jet heads 14, the head driver 82 consisting of a head drive circuit, a driver IC, etc.

The printer controller 70 includes an interface (I/F) 72 for receiving printing data from a host computer and the like through a cable and/or a network, a main control unit 73 consisting of a CPU and the like, RAM 74 for storing data, ROM 75 for storing routines for data processing, an oscillation unit 76, a drive signal generating unit 77 serving as drive pulse generating means for generating drive pulses for the ink jet heads 14, an I/F 78 for sending printing data in the form of dot-pattern data (bit map data), drive pulses, etc., to the head driver 82, and an I/F 79 for sending motor drive data to the motor driver 81.

The RAM 74 serves as various buffers, working memory, etc. The ROM 75 stores various control routines performed by the main control unit 73, font data, graphic functions, various processes, etc.

The main control unit 73 reads the printing data in a receiving buffer included in the I/F 72, and converts the data into intermediary codes. The intermediary codes are stored in an intermediary buffer constituted by a predetermined area of the RAM 74, and are converted to dot-pattern data using font data stored in the ROM 75. The dot-pattern data are stored in a different predetermined area of the RAM 74. In the case that the printing data are converted to bit map data by a printer driver of a host computer, the RAM 74 simply stores the printing data in the bit map format with no need for the conversion as described above.

With reference to FIG. 6, the main control unit 73 then provides 2-bit gradation signals 0 and 1 according to the printing data, a clock signal CLK, a latch signal LAT, and control signals MNO through MN3 to the head driver 82.

As shown in FIG. 6, the drive signal generating unit 77 includes an amplifier 92 and a wave generation unit 91. The wave generation unit 91 contains a ROM, which ROM function may be served by a part of the ROM 75, for storing pattern data of a drive pulse Pv, and a D/A converter for carrying out digital-to-analog conversion of the drive pulse data read from the ROM.

The head driver 82 includes a shift register 103 for inputting the gradation signal 0 and the clock signal CLK from the main control unit 73, a shift register 104 for inputting the gradation signal 1 and the clock signal CLK from the main control unit 73, a latch circuit 105 for latching a register value of the shift register 103 by the latch signal LAT from the main control unit 73, a latch circuit 106 for latching a register value of the shift register 104 by the latch signal LAT from the main control unit 73, a selector 107 for selecting one of the control signals MNO through MN3 from the main control unit 73 based on an output value of the latch circuit 105, and an output value of the latch circuit 106, a level conversion circuit (level shifter) 108 for receiving the output of the selector and for changing the level of the output value from the selector 107, and an analog switch array (switch means) 109, ON/OFF state of which is controlled by the level shifter 108.

The switch array 109 consists of an array of the switches AS1 through ASm to which the drive pulse Pv is provided from the drive signal generating unit 77. Each of the switches AS1 through ASm is connected to one of the piezoelectric devices 52 corresponding to one of the nozzles of one of the recording heads (ink jet head) 14.

The 2-bit gradation signals 0 and 1 serially transmitted from the main control unit 73 are latched by the latch circuits 105 and 106 at the beginning of a printing cycle, and selected ones of the switches AS1 through ASm of the switch array 109 are turned on according to a control signal selected from the control signals MNO through MN3, the control signal selection being based on the gradation data.

While the corresponding one of the switches AS1 through ASm of the switch array 109 is turned on, the drive pulse Pv is applied to the piezoelectric device 52, and the piezoelectric device 52 expands and contracts according to the drive pulse. On the other hand, while the corresponding one of the switches AS1 through ASm is turned off, supply of the drive pulse to the piezoelectric device 52 is interrupted. Here, the signal provided to the switches AS1 through ASm is called the "drive pulse", and the signal that is applied to the piezoelectric device 52 is called the "drive signal".

Here, the shift registers 103 and 104 and latch circuits 105 and 106 are constituted by logic circuits, and the level conversion circuit 108 and the switching circuit 109 are constituted by analog circuits. Further, the circuit arrangement for switching the switch means based on the gradation signal (gradation data) is not limited to the above-mentioned configuration, but any configuration that can turn on/off a desired switch can be used.

Figure 7:
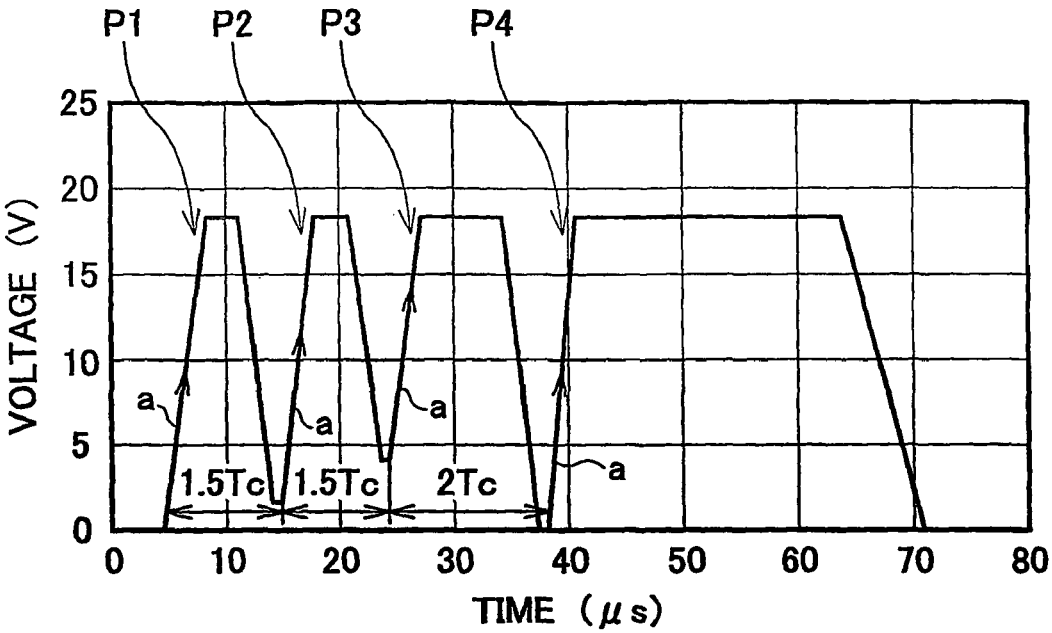
FIG. 7 is a graph showing a drive signal according to the first embodiment of the present invention.

Next, the details of the first embodiment of the present invention are explained with reference to FIG. 7 through FIG. 18. First, FIG. 7 shows the drive pulse according to the first embodiment of the present invention, the drive pulse being the same as the drive signal in the first embodiment. The drive pulse includes a first drive pulse P1, a second drive pulse P2, a third drive pulse P3, and a fourth drive pulse P4 that are output serially (sequentially) in time. At the rising period indicated by a, each drive pulse makes the pressurized ink chamber 46 contract, and makes an ink drop be discharged.

According to the first embodiment, the time interval (discharge interval) between a first ink drop discharged by the first drive pulse P1 and a second ink drop discharged by the second drive pulse P2 is set at 1.5×Tc, the time interval (discharge interval) between the second ink drop discharged by the second drive pulse P2 and a third ink drop discharged by the third drive pulse P3 is set at 1.5×Tc, and the time interval (discharge interval) between the third ink drop discharged by the third drive pulse P3 and a fourth ink drop discharged by the fourth drive pulse P4 is set at 2×Tc. Here, Tc represents the specific vibration cycle of the pressurized ink chamber 46.

Figure 8:
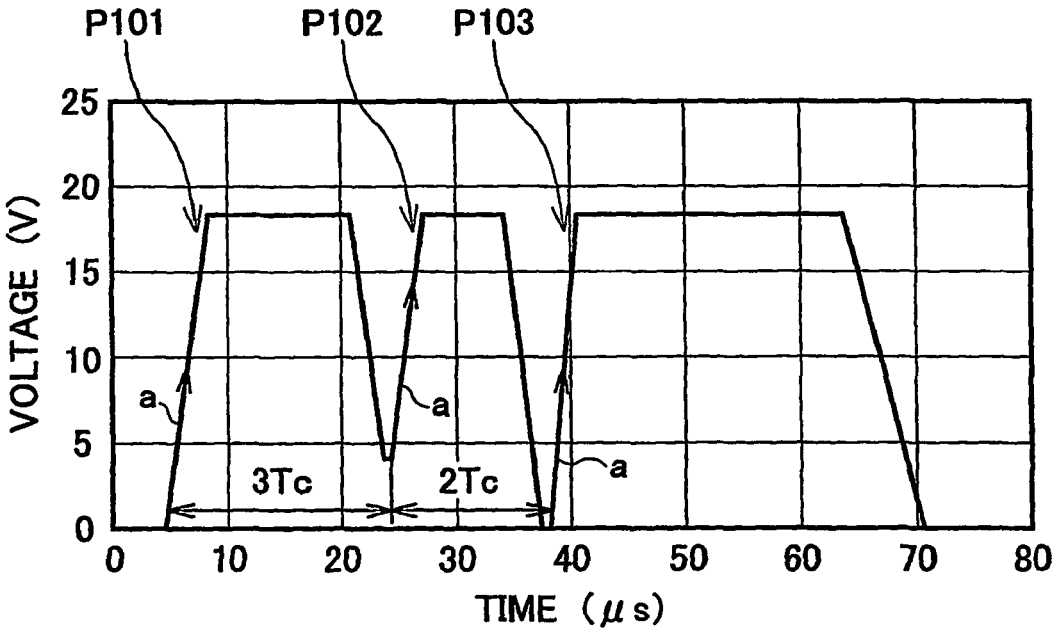
FIG. 8 is a graph showing the drive signal of a first comparative example.

For comparison, a first comparative example is provided. The drive pulse of the first comparative example is as shown in FIG. 8. The first comparative example includes a drive pulse P101, a drive pulse P102, and 4 drive pulse P103 that are output serially in time. These drive pulses make the pressurized ink chamber 46 contract at the pulse rising period indicated by a, and make ink drops be discharged. As seen, the pulse rising period a of the drive pulse P101 is the same as that of the drive pulse P1 of the first embodiment, the drive pulse P2 of the first embodiment is eliminated, (i.e., the pulse rising period a of the drive pulse P2 is not present in the first comparative example), the drive pulse P102 is the same as the drive pulse P3, and the drive pulse P103 is the same as the drive pulse P4.

Accordingly, as for the first comparative example, the time interval between the first ink drop discharged by the drive pulse P101 and the second ink drop discharged by the drive pulse P102 is nearly equal to 3 Tc (i.e., 1.5 Tc×2), and the time interval between the second ink drop discharged by the drive pulse P102 and the third ink drop discharged by the drive pulse P103 is nearly equal to 2 Tc.

Figure 9:
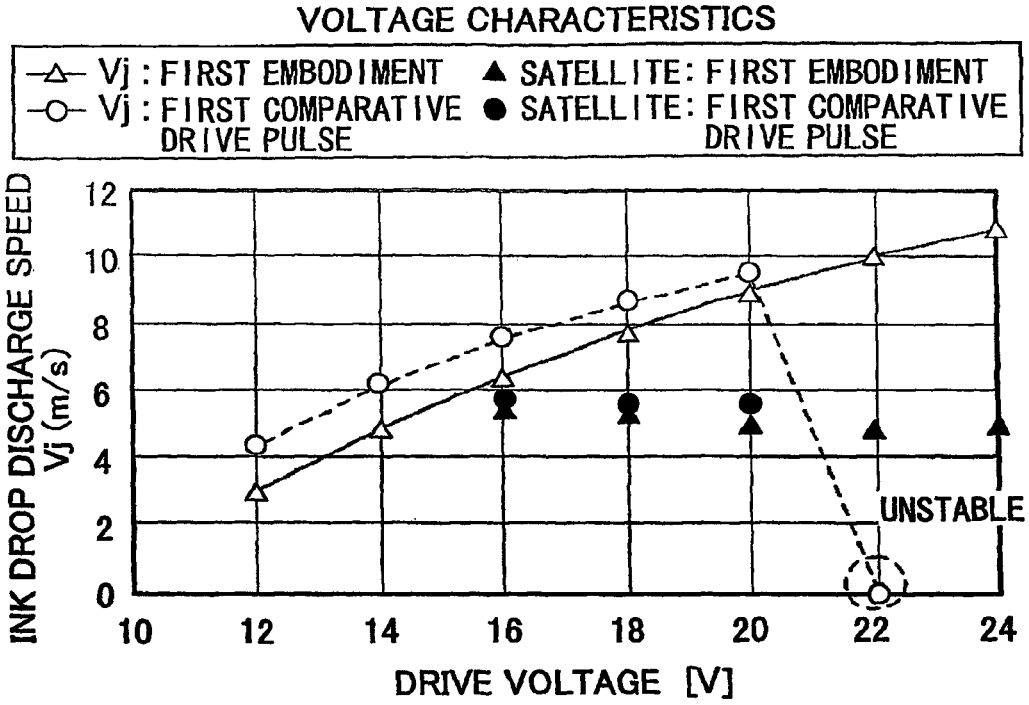
FIG. 9 is a graph for explaining relations between ink drop speed and voltage in the cases of the first embodiment and the first comparative example.
Figure 10:
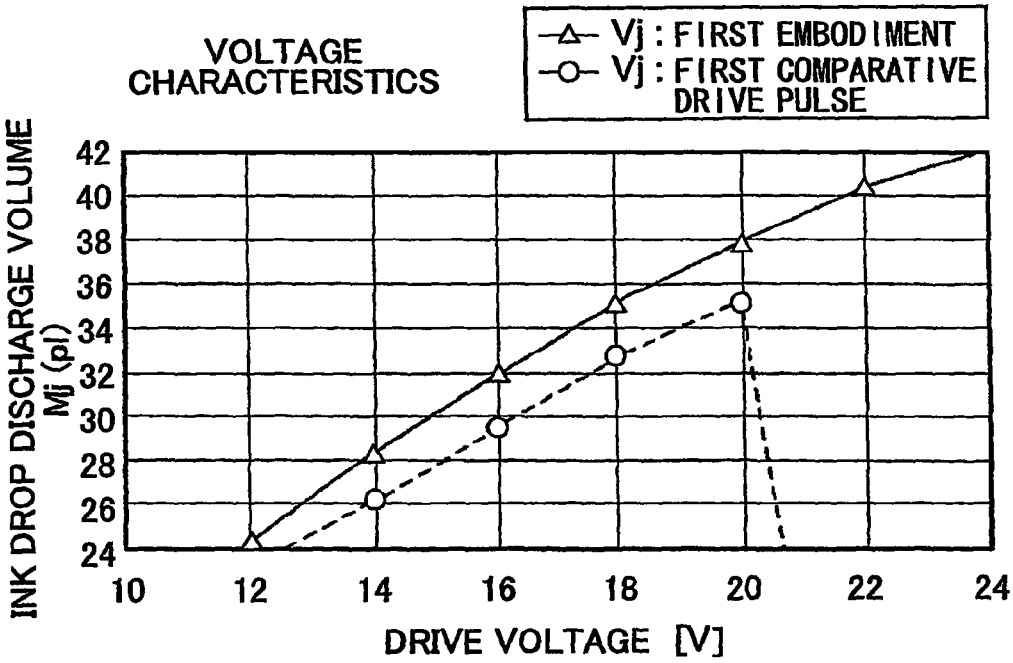
FIG. 10 is a graph for explaining relations between ink drop volume and voltage in the cases of the first embodiment and the first comparative example.

Then, ink drop discharge was experimented with using the drive pulse of the first embodiment and the drive pulse of the first comparative example. The results are shown in FIG. 9 and FIG. 10. In FIG. 9, the results of the ink drop speed Vj (vertical axis) corresponding to the maximum voltage of the drive pulse (horizontal axis) are shown. In FIG. 10, the results of the ink drop volume Mj (vertical axis) corresponding to the maximum voltage of the drive pulse (horizontal axis) are shown. For the purposes of FIG. 9 and FIG. 10, the drive pulse wave forms in FIG. 7 and FIG. 8 were similarly transformed, i.e., gain adjustments were carried out. Further, repetition frequency was set to 8 kHz. Here, the solid line in each of FIG. 9 and FIG. 10 shows the results of the first embodiment, and the dashed line shows the results of the first comparative example.

As shown in FIG. 9 and FIG. 10, in the case of the first comparative example, ink drop discharge became unstable at the driver voltage of 22 V. Although the vertical value for 22 V is shown as being zero, this does not mean that there was no discharge, but the discharge was unstable, and measurement of an exact numeric value was impossible. This unstable discharge was determined to be due to the surface of the nozzle being dirty, which was caused by a meniscus significantly rising due to the residual pressure (or a very slow discharge speed) after discharge of the last ink drop (the third ink drop), and the ink was not drawn back into the nozzle.

On the other hand, in the case of the drive pulse of the first embodiment, even if the driver voltage was increased to 24 V, ink drop discharge was not disturbed. Further, for the same voltages, the drive pulse of the first embodiment discharged a greater ink drop volume Mj than the first comparative example, although four ink drops were discharged according to the first embodiment.

That is, the first embodiment more stably discharged a large ink drop. Since the time from the first discharge to the last discharge was the same, the large ink drop was obtained with no additional time required, and it was easy for the last ink drop to merge with the first ink drop.

Figure 11:
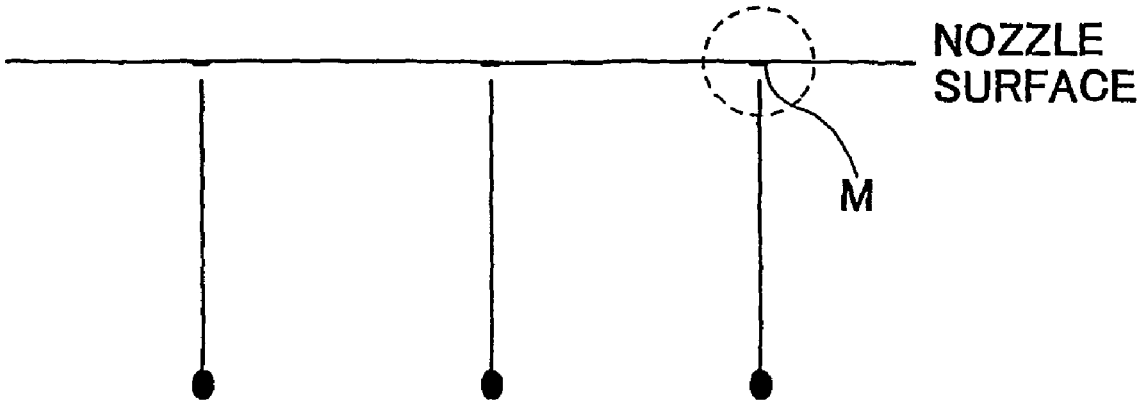
FIG. 11 shows ink drop discharging situations corresponding to the drive pulse of the first embodiment.
Figure 12:
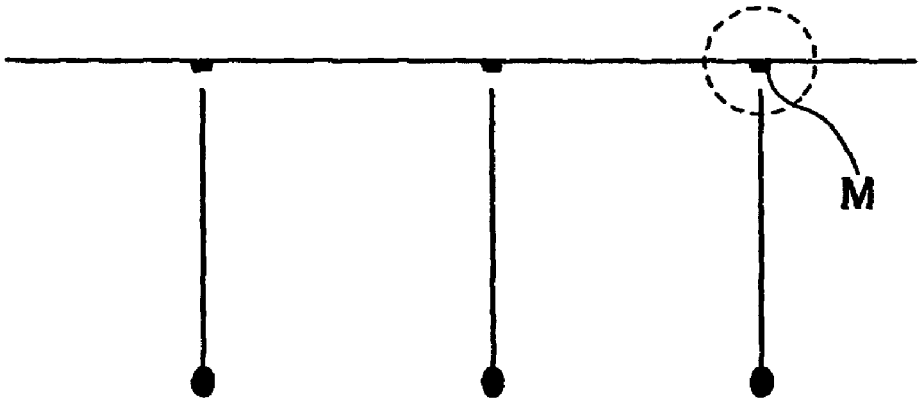
FIG. 12 shows ink drop discharging situations corresponding to the drive pulse of the first comparative example.

FIG. 11 shows a discharge state in the case of the first embodiment. FIG. 12 shows a discharge state in the case of the first comparative example. Here, the maximum voltage of the drive pulse of the first embodiment was set at 16.9 V, and the maximum voltage of the first comparative example was set at 15.3 V, both voltages being determined based on the characteristics shown by FIG. 9 such that the same ink drop speed of Vj=7 m/s was obtained in both cases. Using a stroboscope, the situation near the nozzle was observed 80 μs after the drive signal was generated. Here, the repetition frequency was set at 4 kHz.

The difference between FIG. 11 and FIG. 12 is that a meniscus M due to the residual pressure vibration was visibly present after discharge in FIG. 12 (the first comparative example), while there was no meniscus observed in the case of the first embodiment. This provides evidence that the drive pulse of the first embodiment successfully suppressed the residual pressure vibration.

Figure 13:
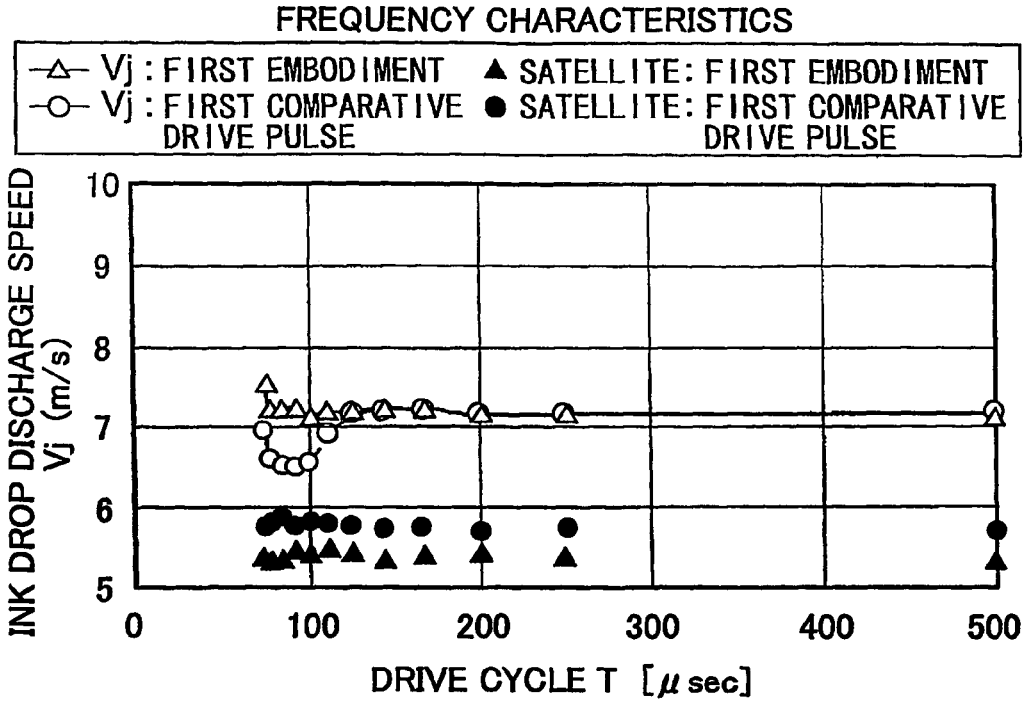
FIG. 13 graphs frequency characteristics of the ink drop speed in the cases of the first embodiment and the first comparative example.
Figure 14:
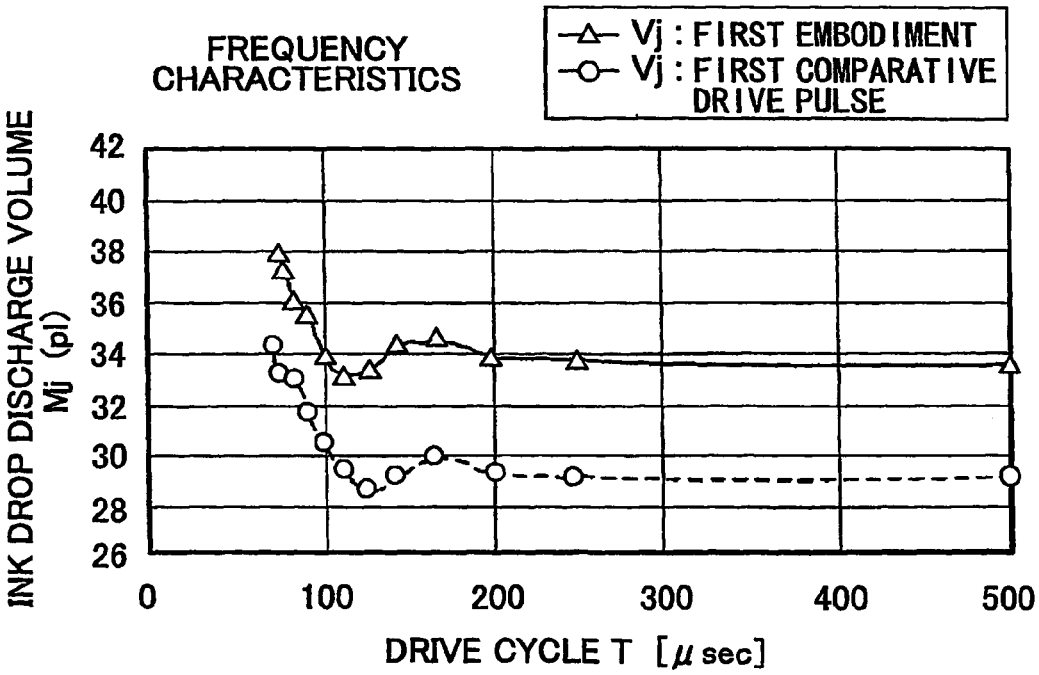
FIG. 14 graphs frequency characteristics of the ink drop volume in the cases of the first embodiment and the first comparative example.

The residual pressure vibration also affected frequency characteristics of discharging. FIG. 13 and FIG. 14 show the frequency characteristics, the ink drop speed Vj and the ink drop volume Mj, respectively, according to the drive pulse of the first embodiment and the first comparative example. In FIG. 13 the vertical axis represents the ink drop speed Vj, and in FIG. 14 the vertical axis represents the ink drop volume Mj. The horizontal axes of FIG. 13 and FIG. 14 represent the repetition cycle T. Here, the maximum voltage of the drive pulse of the first embodiment was set at 16.9 V, and the maximum voltage of the first comparative example was set at 15.3 V, both voltages being determined based on the characteristics shown by FIG. 9 such that the same ink drop speed of Vj=7 m/s was obtained in both cases. Further, the solid line shows the result of the first embodiment, and the dashed line shows the result of the first comparative example.

As seen from FIG. 13, the drive pulse of the first embodiment provided better flatness of the ink drop speed Vj than the first comparative example. This indicates that where the residual pressure was small, the influence of the repetition cycle becoming short on the discharging characteristics was small. Further, that the frequency characteristic of the ink drop speed Vj was flat means that an impact position (where the ink drop arrives on the recording medium) did not fluctuate with an image pattern, and that discharge stability was improved.

Further, as seen from FIG. 14, there was no significant difference between the first embodiment and the first comparative example as for the range of fluctuation (ΔMj) of the frequency characteristics of the ink drop volume Mj. Nevertheless, the drive pulse of the first embodiment discharged a greater amount of the ink than the drive pulse of the first comparative example.

Figure 15:
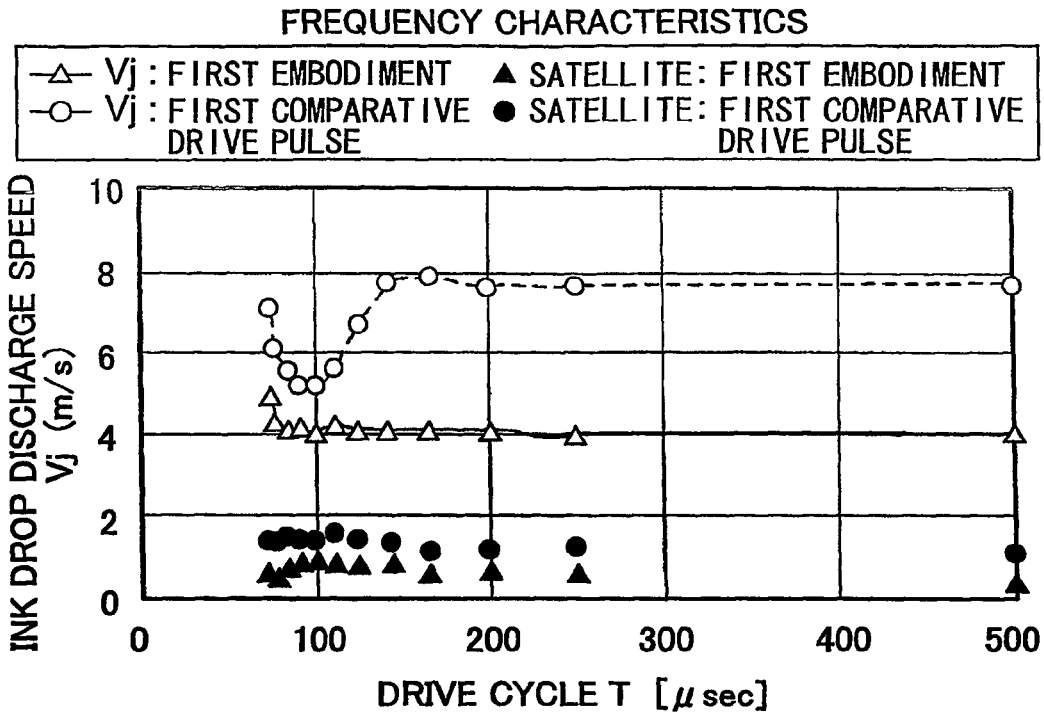
FIG. 15 graphs frequency characteristics of the ink drop speed for the same ink drop volume in the cases of the first embodiment and the first comparative example.
Figure 16:
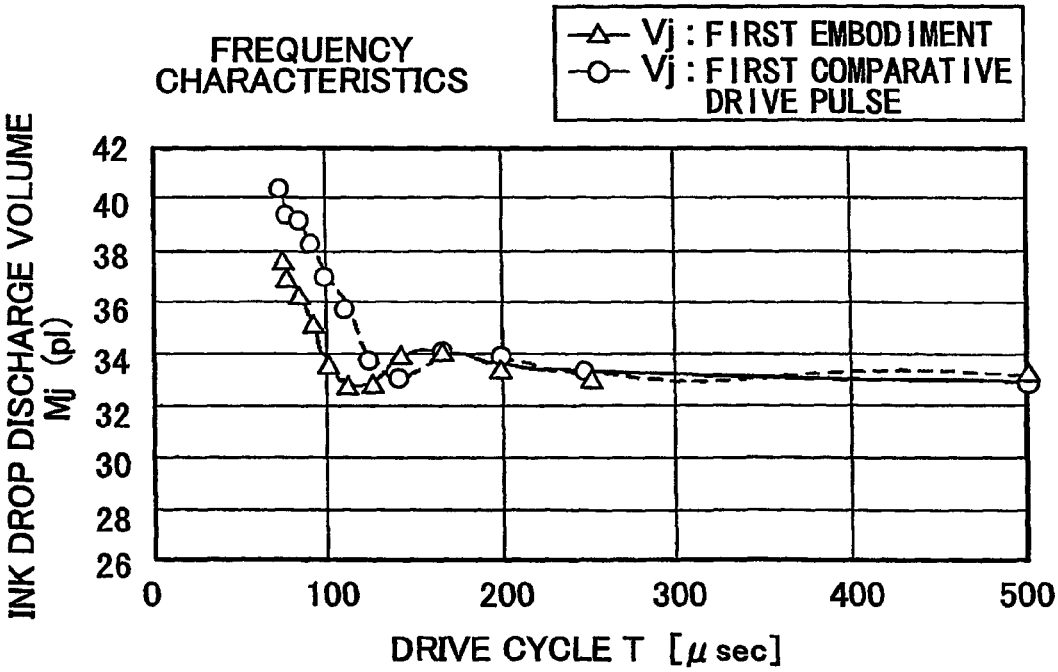
FIG. 16 graphs frequency characteristics of the ink drop volume for the same ink drop speed in the cases of the first embodiment and the first comparative example.

Next, FIG. 15 and FIG. 16 show the frequency characteristics when the maximum voltage of the first comparative example was raised to 18.5 V so that the ink drop volume Mj became the same as that of the first embodiment. In FIG. 15, the vertical axis represents the ink drop speed Vj, and in FIG. 16 the vertical axis represents the ink drop volume Mj. Here, the data of the drive pulse of the first embodiment in FIG. 15 and FIG. 16 are the same as the data identified by "Vj: FIRST EMBODIMENT" in FIG. 13 and FIG. 14, respectively.

As clearly seen from FIG. 15 and FIG. 16, when the ink drop volume Mj to be discharged was equalized, the fluctuation of the ink drop speed Vj of the first comparative example became greater than before (when the applied voltage was 15.3 V, i.e., in the case of FIG. 13), and the drive pulse of the first embodiment provided the smaller range of fluctuation ΔMj of the ink drop volume Mj.

The mechanism of the first embodiment is explained with reference to FIG. 17 and FIG. 18 that show the discharge state of the ink drops according to the drive pulse of the first embodiment and the drive pulse of the first comparative example, respectively. Here, the maximum voltage of the drive pulse of the first embodiment was set at 16.9 V, and the maximum voltage of the first comparative example was set at 15.3 V, both voltages being determined based on the characteristics shown by FIG. 9 such that the same ink drop speed of Vj=7 m/s was obtained in both cases. The stroboscope method was used to observe the situation near the nozzle 43 μs after the drive signal was generated. Here, the timing, i.e., 43 μs, is when the last ink drop began to be discharged from the nozzle.

Figure 17:
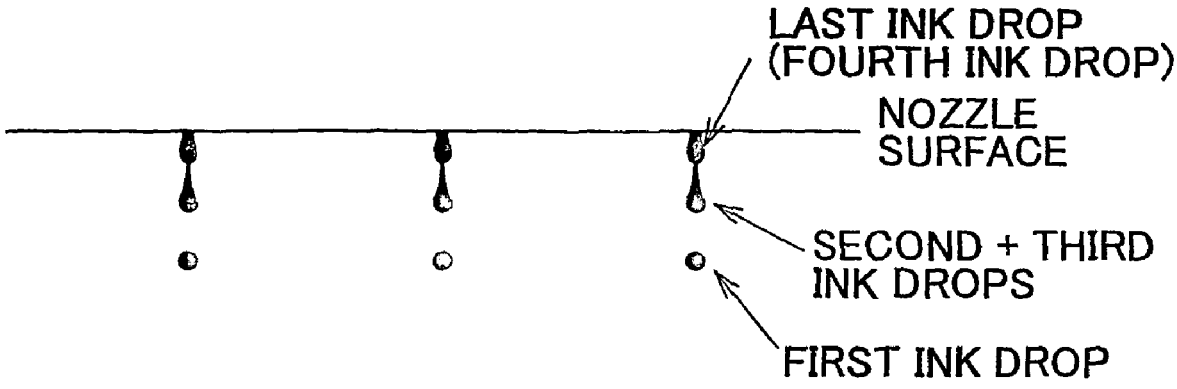
FIG. 17 shows ink drop discharging situations corresponding to the drive pulse of the first embodiment.
Figure 18:
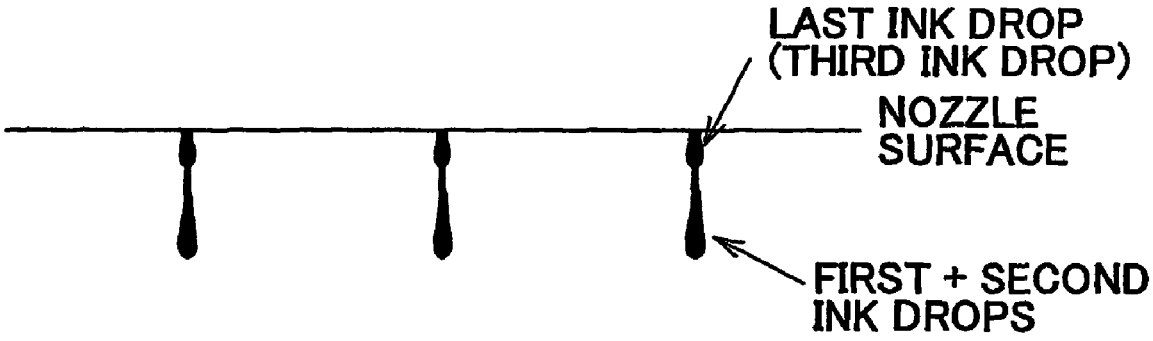
FIG. 18 shows ink drop discharging situations corresponding to the drive pulse of the first comparative example.

In the case of the first embodiment, the second ink drop and the third ink drop had not reached the first ink drop as shown in FIG. 17. On the other hand, in the case of the first comparative example, the second ink drop had merged with the first ink drop as shown in FIG. 18. That is, in the case of the drive pulse of the first embodiment, discharging at the 1.5 Tc intervals causes the residual pressure and the discharge pressure to cancel each other, and the speed of the second ink drop and the third ink drop became slower. Nevertheless, it is important that discharging be correctly carried out even if the speed is low.

Here, if the voltage of the drive pulse is made lower, like the so-called damping wave, in an attempt to suppress the residual pressure vibration after the first ink drop, sufficient effect is not achieved. Rather, by generating a pressure that can cause the second ink drop to be correctly discharged, the effect as in this embodiment is achieved.

Further, since the last ink drop (the fourth ink drop) needs to gather in the second and the third ink drops that travel at a slow speed, and merge with the first ink drop, the last ink drop has to be discharged at an n×Tc interval with the preceding ink drop, not at an (n+1/2)×Tc interval. According to the present embodiment, for the last ink drop, the n×tc interval is used and ink drop speed is made higher.

As described above, when multiple ink drops are to be sequentially discharged, ink drops other than the last ink drop are discharged at intervals nearly equal to (n+1/2)×Tc (where, n is an integer equal to or greater than 1) in order to suppress the pressure vibration of the pressurized ink chamber, and the last ink drop is discharged at an interval nearly equal to n×Tc in order to form a large ink drop.

In this manner, a subsequent ink drop can be discharged earlier than before (with no need to wait for decay of the residual pressure due to the preceding ink drop), and the time required to form a large ink drop can be shortened, resulting in high printing speed. Further, since the time from the first ink drop to the last ink drop is shortened, it is easy for the last ink drop to merge with the preceding ink drops, which merging suppresses the speed of the last ink drop. In this manner, a satellite SATE (unconverged ink drop) (see FIGS. 15 and 17) that otherwise reaches the recording medium later than a main drop can now reach the recording medium after merging.

In this case, the ink drop formation time can be further shortened by making n=1, i.e., causing the ink drop to be discharged at an interval nearly equal to 1.5×Tc after the preceding ink drop, the interval suppressing the pressure vibration.

Further, ink drops other than ink drops that are discharged at intervals nearly equal to (n+1/2)×Tc from the corresponding preceding ink drops are discharged at intervals of nearly equal to n×Tc from the corresponding preceding ink drops. Since the interval n×Tc is in sync with the peak of the pressure vibration, variances of the discharge characteristics, i.e., Vj and Mj, due to a variation in the head, and a specific vibration cycle shift due to an external cause can be minimized.

In this manner, i.e., by providing ink drops discharged at intervals of nearly equal to (n+1/2)×Tc from the preceding ink drop, except for the last ink drop, the pressure vibration of the pressurized ink chamber is prevented from becoming excessive.

In addition, although the piezoelectric vibrator displacing in the d33 directions is used as the actuator of the ink jet head, other actuators can be used such as a piezoelectric vibrator displacing in d31 directions.

However, it is desirable that the specific vibration cycle Tc be short such that two or more ink drops can easily merge, and the passage board constituting the pressurized ink chamber can be firmly held. That is, as for the head structure, the so-called bi-pitch structure is desirable wherein comb-like sliced portions of the actuator that are not driven support the partitions of the pressurized ink chamber.

In addition, it is more desirable that the piezoelectric device as the actuator be capable of quick response, and for this reason, the piezoelectric device should be structured with a low profile. For this purpose, it is desirable that the actuator use a piezoelectric device that displaces in the d33 directions, because the piezoelectric constant is greater with d33 than d31.

Figure 19:
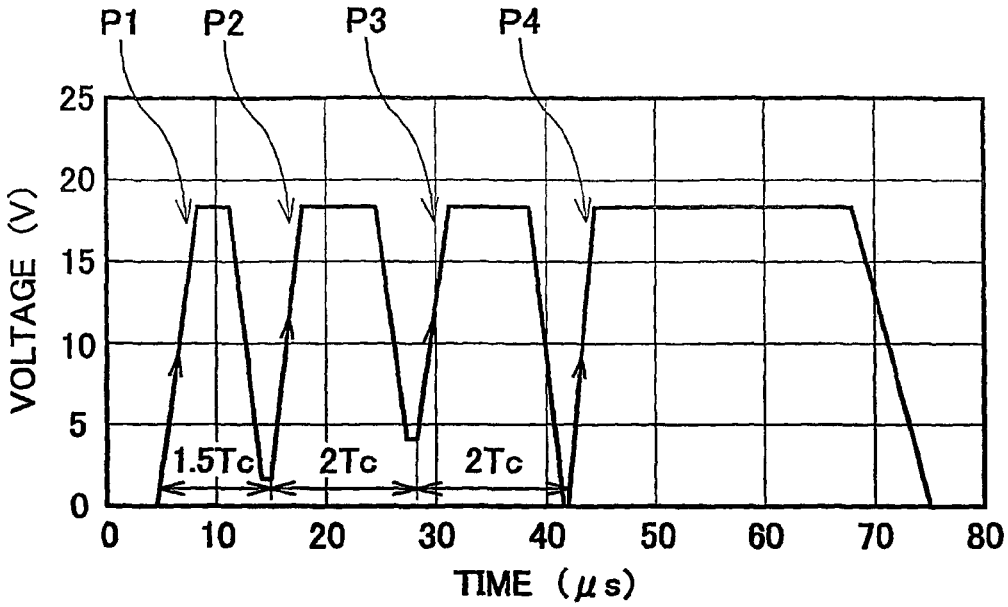
FIG. 19 graphs the drive signal according to the second embodiment of the present invention.
Figure 20:
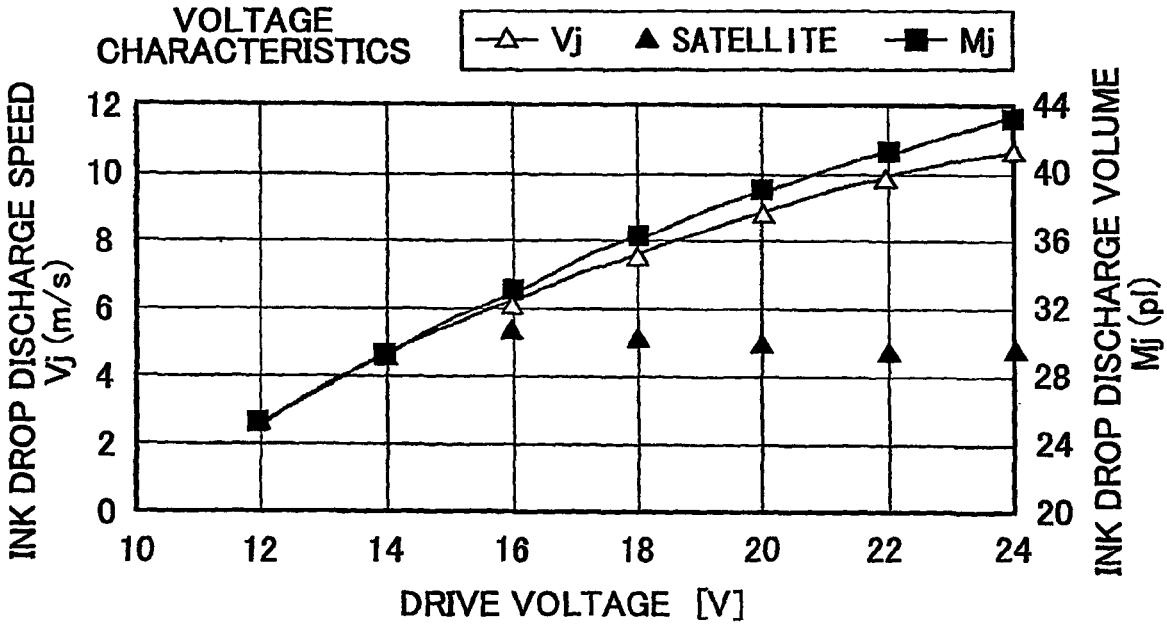
FIG. 20 graphs voltage characteristics of the drive pulse according to the second embodiment.

Next, the drive pulse according to the second embodiment of the present invention is explained with reference to FIG. 19 and FIG. 20. The drive pulse of the second embodiment is designed such that the interval between the first ink drop discharged by the driving pulse P1 and the second ink drop discharged by the driving pulse P2 is set at 1.5 Tc, the interval between the second pulse discharged by the driving pulse P2 and the third ink drop discharged by the driving pulse P3 is set at 2 Tc, and the interval between the third pulse discharged by the driving pulse P3 and the fourth ink drop discharged by the driving pulse P4 is set at 2 Tc. The voltage characteristics of the second embodiment are shown in FIG. 20. In addition, the head structure is the same as that of the first embodiment.

In this drive pulse, the second ink drop is discharged at the 1.5 Tc interval from the first ink drop, which works such that the second ink drop cancels the residual pressure vibration. To the contrary, the third ink drop and the fourth ink drop are discharged at intervals of 2 Tc to the respective preceding ink drops, which intervals tend to increase the residual pressure vibration, and indeed a meniscus after discharge was slightly visible as compared with the first embodiment. However, the discharge did not become unstable, even when the driver voltage was raised to 24 V as shown in FIG. 20. Further, the ink drop volume Mj of the second embodiment was greater than the first embodiment at the same voltages.

Figure 21:
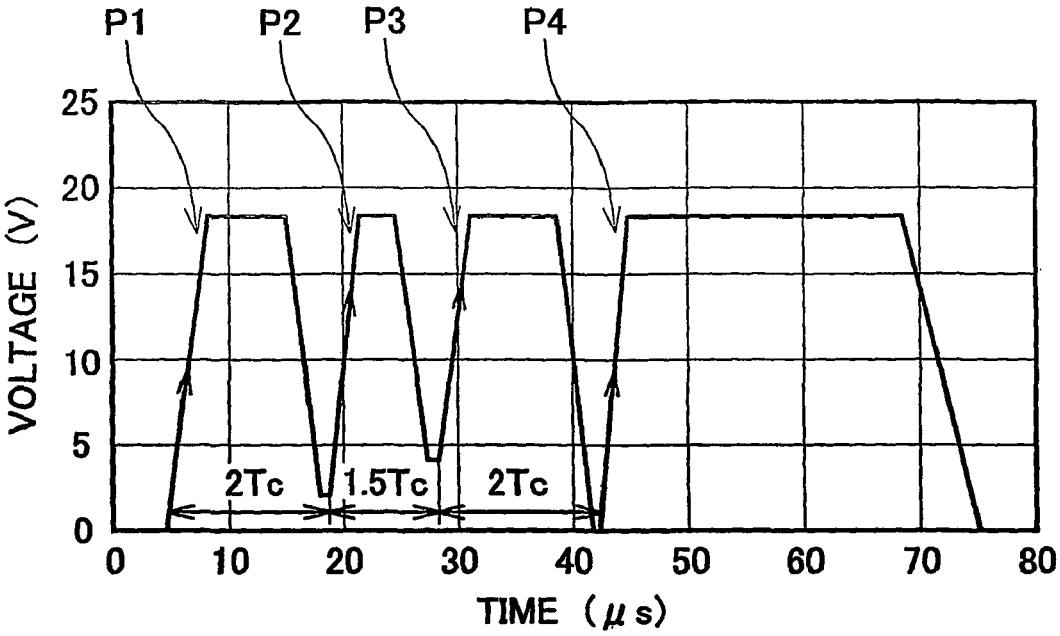
FIG. 21 graphs the drive signal according to the third embodiment of the present invention.

Next, the drive pulse according to the third embodiment of the present invention is explained with reference to FIG. 21. The drive pulse of the third embodiment is designed such that the interval between the first ink drop discharged by the driver pulse P1 and the second ink drop discharged by the driver pulse P2 is set to 2 Tc, the interval between the second ink drop discharged by the drive pulse P2 and the third ink drop discharged by the drive pulse P3 is set to 1.5 Tc, and the interval between the third ink drop discharged by the drive pulse P3 and the fourth ink drop discharged by the drive pulse P4 is set to 2 Tc. Here, the head structure is the same as that of the first embodiment.

According to the drive pulse of the third embodiment, the third ink drop is discharged at an interval nearly equal to 1.5 Tc after the second ink drop, the third ink drop canceling out the residual pressure vibration.

Figure 22:
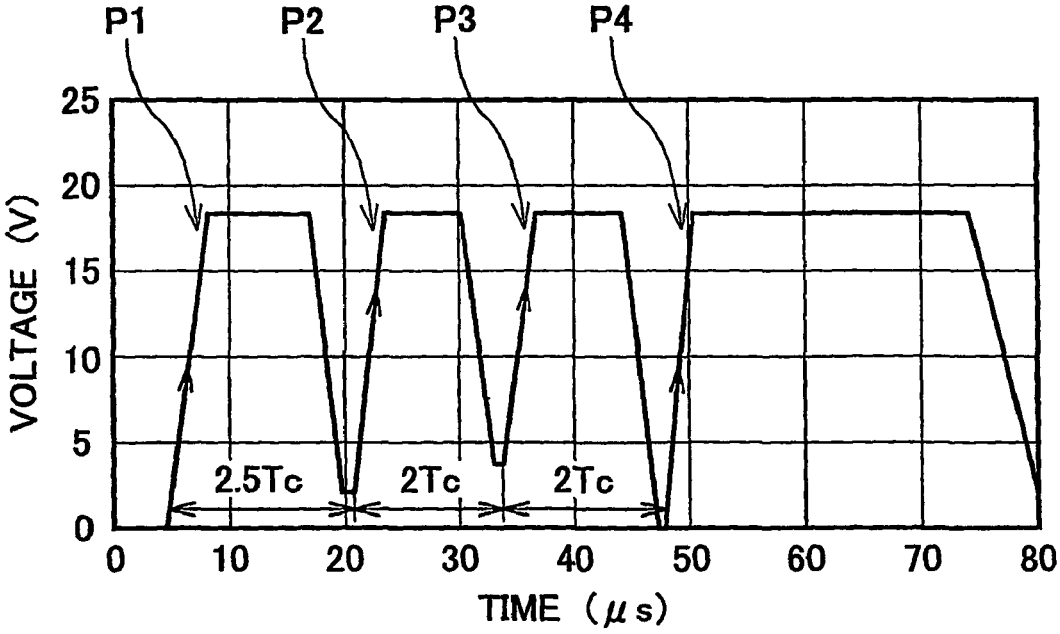
FIG. 22 graphs the drive signal according to the fourth embodiment of the present invention.

Next, the drive pulse of the fourth embodiment is explained with reference to FIG. 22. According to the drive pulse of the fourth embodiment, the interval between the first ink drop discharged by the drive pulse P1 and the second ink drop discharged by the drive pulse P2 is set to 2.5 Tc (i.e., n=2), the interval between the second ink drop discharged by the drive pulse P2 and the third ink drop discharged by the drive pulse P3 is set to 2 Tc, and the interval between the third ink drop discharged by the drive pulse P3 and the fourth ink drop discharged by the drive pulse P4 is set to 2 Tc. Here, the head structure is the same as that of the first embodiment.

In this drive pulse, the second ink drop is discharged at an interval nearly equal to 2.5 Tc after the first ink drop, the second ink drop canceling out the residual pressure vibration.

The first through the fourth embodiments of the present invention provide drive pulses (i.e., a drive signal for forming a large ink drop) that widen the available voltage range, within which voltage range operations are stable without excessive vibration due to the residual pressure.

Nevertheless, from the viewpoint of merging all the four ink drops, the second embodiment is more preferred to the fourth embodiment, because the total interval from the first ink drop to the fourth ink drop of the fourth embodiment is 6.5 Tc that is longer than the second embodiment where the total interval is 5.5 Tc.

Figure 23:
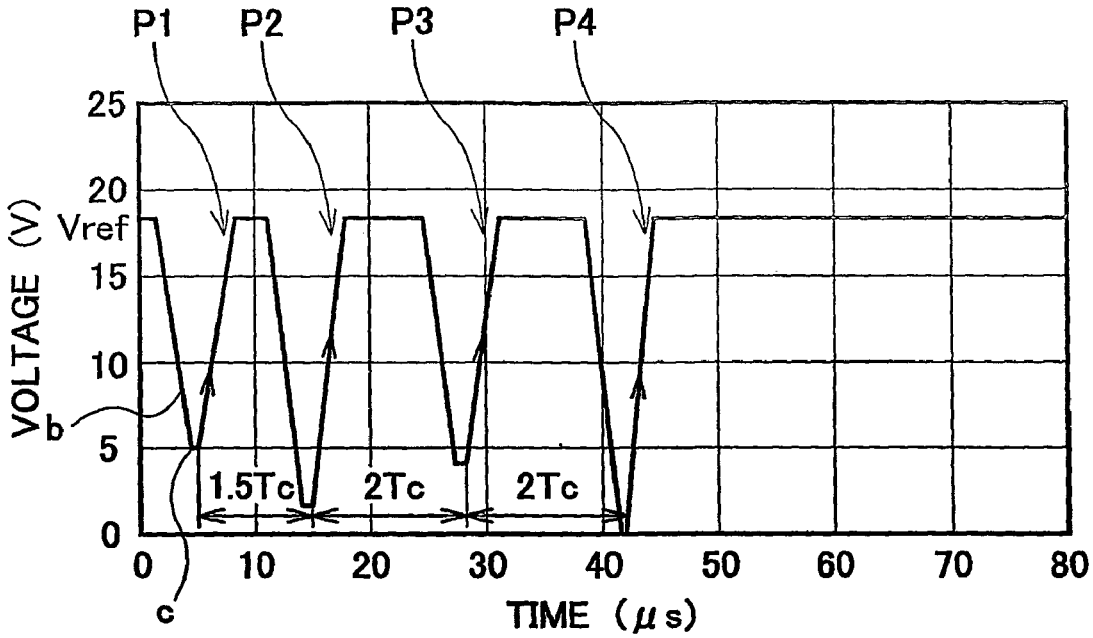
FIG. 23 graphs the drive signal according to the fifth embodiment of the present invention.

Next, the drive pulse of the fifth embodiment is explained with reference to FIG. 23. According to the drive pulse of the fifth embodiment, the first ink drop is discharged by "pull and strike", that is, the pressurized ink chamber 46 is first expanded, and then contracted to discharge the first ink drop. For this purpose, a wave element b wherein the voltage falls from a reference voltage Vref, and a wave element c wherein the expansion state of the pressurized ink chamber 46 is maintained are inserted before the drive pulse P1.

In the fifth embodiment, the interval between the first ink drop discharged by the drive pulse P1 and the second ink drop discharged by the drive pulse P2 is set to 1.5 Tc, the interval between the second ink drop discharged by the drive pulse P2 and the third ink drop discharged by the drive pulse P3 is set to 2 Tc, and the interval between third ink drop discharged by the drive pulse P3 and the fourth ink drop discharged by the drive pulse P4 is set to 2 Tc.

In this drive pulse sequence, the second ink drop is discharged at an interval nearly equal to 1.5 Tc after the first ink drop, the second ink drop canceling out the residual pressure vibration.

The "pull and strike" has pros and cons. Drawbacks include the first ink drop becoming small due to the meniscus being once drawn back when the pressurized ink chamber is expanded, and there being difficulties in controlling because change of ink drop speed to voltage change is great (i.e., inclination of the voltage characteristic is steep) due to piled up pressure of expansion and contraction. Advantages include the total wave time being short because time to return to the reference voltage is not needed, and the injection direction being correctly maintained with the meniscus being drawn back once even when the nozzle is dirty.

As described above, the present invention can be applied to the case where the first ink drop is discharged by "pull and strike".

Figure 24:
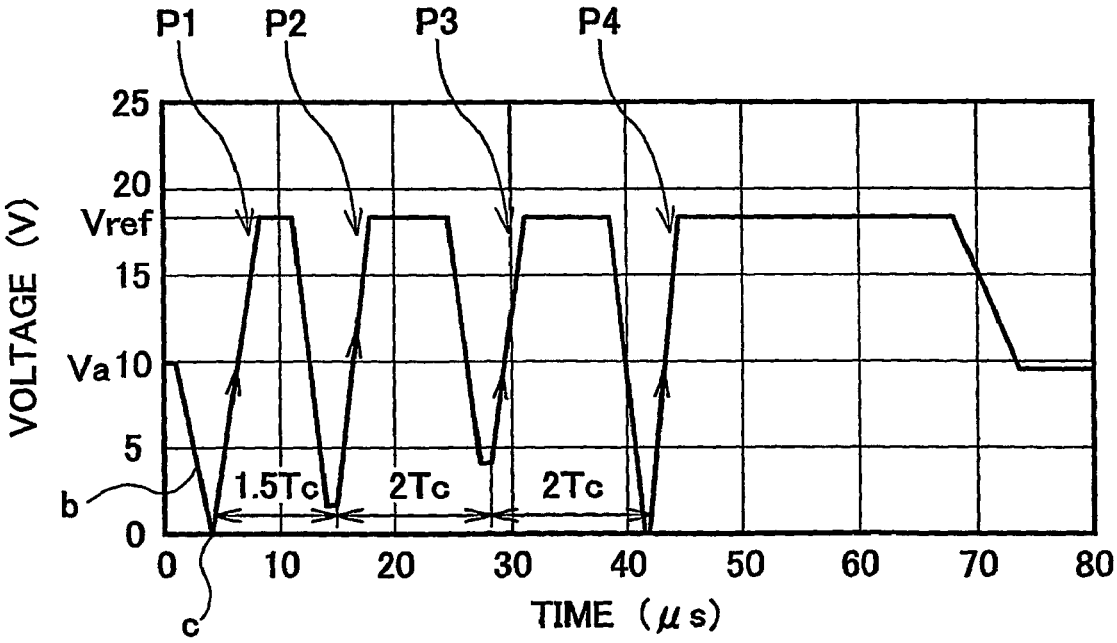
FIG. 24 graphs the drive signal according to the sixth embodiment of the present invention.

Next, the drive pulse of the sixth embodiment of the present invention is explained with reference to FIG. 24. According to the drive pulse of the sixth embodiment, the pressurized ink chamber is first expanded, and then contracted for discharging the first ink drop; however, the contraction volume is greater than the expansion volume, which provides discharging in the middle of "pull and strike" (the fifth embodiment) and "push and strike" (the first through the fourth embodiments). Specifically, the wave element b for expanding the pressurized ink chamber 46, and the wave element c for holding the expansion state of the pressurized ink chamber 46 are inserted before the drive pulse P1, wherein the wave form b starts falling from a voltage Va that is lower than the reference voltage Vref.

The intervals between the drive pulses P1, P2, P3 and P4 are the same as the fifth embodiment.

Accordingly, the second ink drop is discharged at an interval nearly equal to 1.5 Tc after the first ink drop, the second ink drop canceling out the residual pressure vibration.

The sixth embodiment of the present invention is characterized by discharging a large ink drop, while retaining the advantages of the fifth embodiment. In order to enlarge the ink drop volume Mj with a small number of pulses, the second embodiment (wherein the first ink drop is discharged by "push and strike"), and the sixth embodiment (wherein the first ink drop is discharged "pull and strike" where the contraction volume is greater than the expansion volume) are advantageous.

Figure 25:
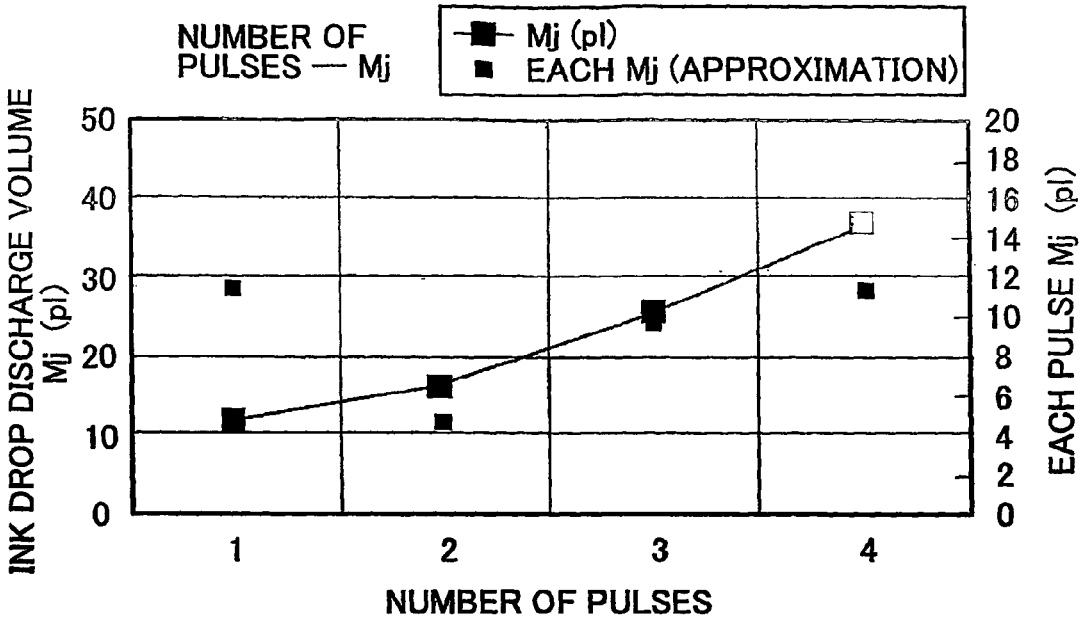
FIG. 25 graphs relations between the ink drop volume and the number of pulses corresponding to the drive pulse according to the first embodiment.

Next, the interval between the drive pulse for discharging the first ink drop and the second drive pulse for discharging the second ink drop is explained with reference to FIG. 25. FIG. 25 shows how the ink drop volume Mj increases as the number of pulses is increased in the case of the drive pulse of the second embodiment ("push and strike"). Each time a pulse was transmitted, the total "discharge volume Mj" was measured, and the volume of each drop was obtained by calculating the difference, i.e., the increment.

The reason why the volume of the second ink drop is small is that the pressurized ink chamber 46 was not sufficiently refilled with ink after discharging the first ink drop of great volume, and the meniscus was drawn back. Since the meniscus was restored as it proceeded to the third ink drop and the fourth ink drop, the volumes of the third and the fourth ink drops became great.

Figure 26:
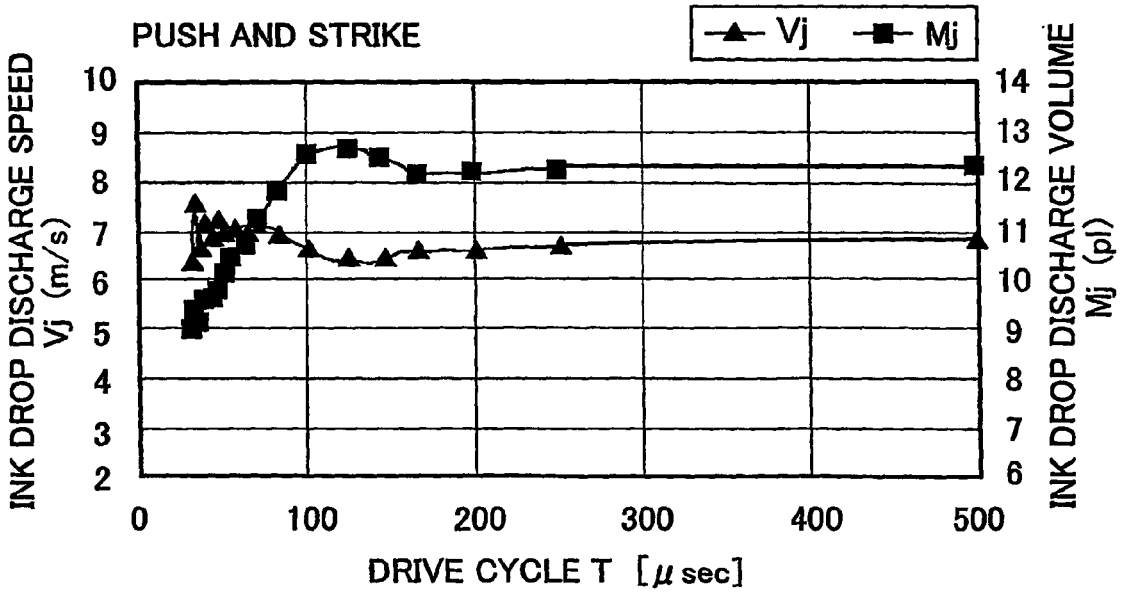
FIG. 26 graphs relations between the ink drop volume and ink drop speed corresponding to the drive cycle of the drive pulse according to the first embodiment.

FIG. 26 shows the frequency characteristics of a pulse in the case of "push and strike" for reference. If the discharge interval becomes short (i.e., the frequency is high), since the meniscus is not restored, the ink drop volume Mj tends to be small as clearly seen from FIG. 26. The result shown by FIG. 25 (the second ink drop volume being small) is largely attributed to the meniscus not being restored in time.

For a given amount of energy, if the ink drop volume Mj is made small, the ink drop speed Vj becomes great. Accordingly, in the case of the second embodiment ("push and strike") and the sixth embodiment ("pull and strike"), as for the second ink drop, the ink drop speed Vj tends to become high, because the meniscus is drawn back, and the ink drop volume Mj is small as shown in FIG. 25.

In order to prevent the ink drop speed from becoming excessively high, the second ink drop is discharged at the interval nearly equal to Tc×(n+1/2) after the first ink drop as practiced in the drive pulse of the second embodiment and the drive pulse of the sixth embodiment. In this manner, a wider range wherein stable discharge is available is obtained.

Next, the ink drop speed of an ink drop following a preceding ink drop is explained with reference to FIG. 27 and FIG. 28. The ink drop speed Vj and the ink drop volume Mj of the drive pulse of the first embodiment were measured by making a voltage Vp2 of the drive pulse P2 into a parameter, Vp2 being shown in FIG. 27. The results are shown in FIG. 28.

Figure 28:
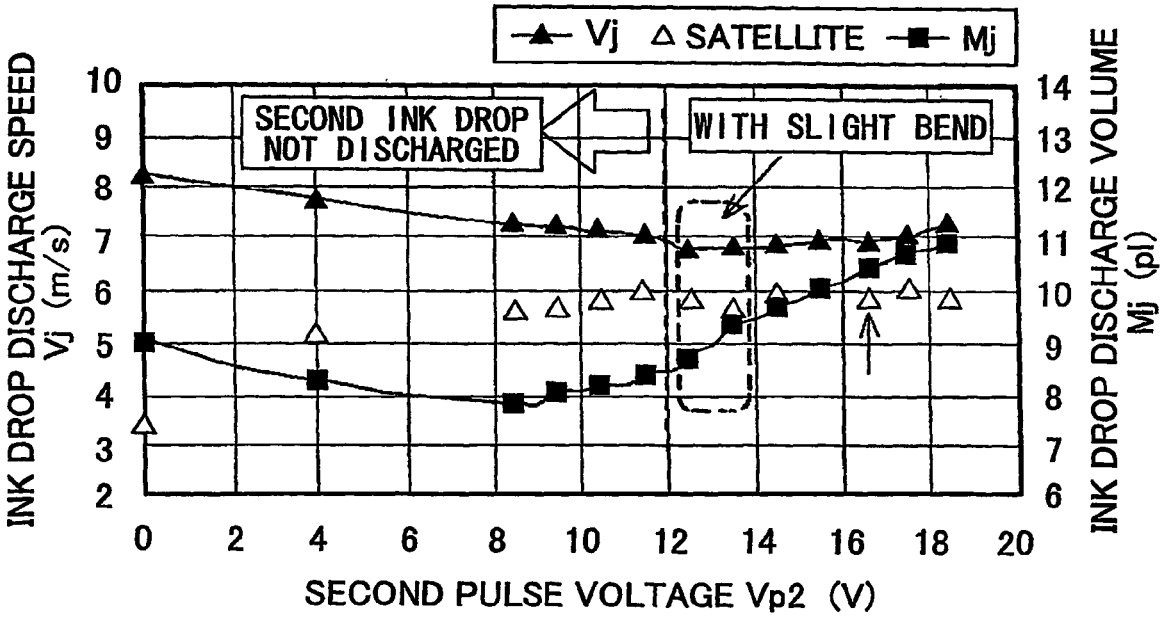
FIG. 28 graphs a voltage waveform of the drive pulse for discharging the second ink drop.

As seen from FIG. 28, as the voltage of the drive pulse P2 is raised, the residual pressure vibration is cancelled out little by little, and both the ink drop speed Vj and the ink drop volume Mj become small. Further, the second ink drop was not discharged at voltages lower than 12 V, and the second ink drop starts to be discharged at slightly above 12 V; however, the injection direction was bent (deflected from the downward direction). This is because the second ink drop somehow floated, rather than flew, due to the voltage of the drive pulse P2 being too low, which resulted in the third and subsequent ink drops merging at a deflected angle. Accordingly, it was determined that a certain amount of speed is required for the second ink drop.

In order for the direction bend not to occur, a speed higher than 2 m/s was required for the second ink drop. This was determined by measuring the time required for the second ink drop to reach 1 mm ahead without discharging the third and the fourth ink drops.

On the other hand, making the second ink drop speed too high produces a satellite that is separated from the main ink drop, which is not desirable. Thus, the highest speed for the second ink drop is limited. In the case of this embodiment, when the ink drop speed exceeded 7 m/s, a satellite was produced.

Figure 27:
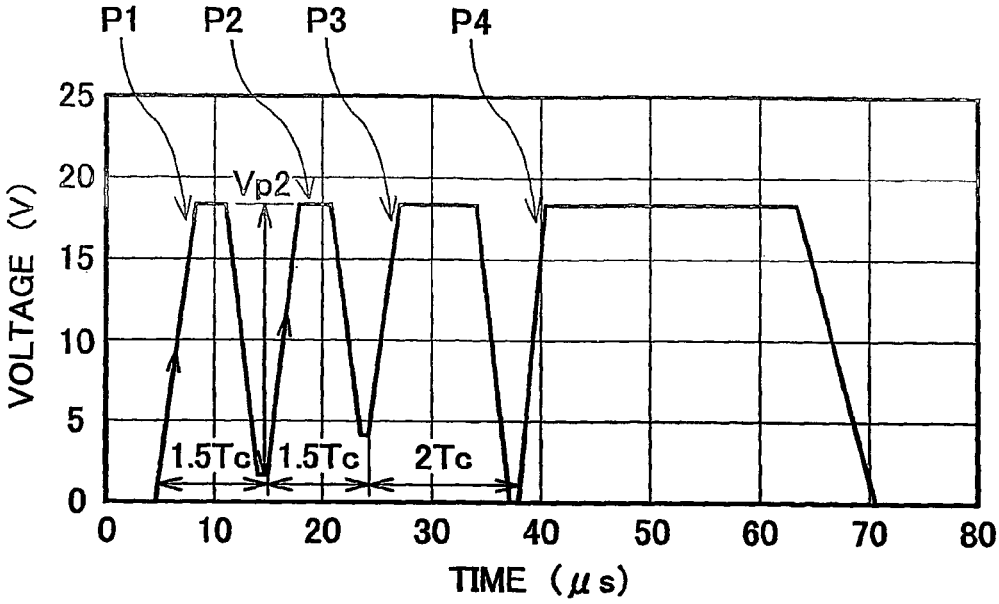
FIG. 27 graphs a voltage waveform of the drive pulse for discharging the second ink drop.

When the whole drive pulse shown in FIG. 27 was shifted upward (given a voltage offset), and the voltage Vp2 of the drive pulse P2 was further increased, discharge had a tendency to become unstable from the vicinity where a satellite was produced by the second ink drop.

Accordingly, as for the ink drop that is discharged at an interval of Tc×(n+1/2) to the preceding ink drop, it is desirable that the ink drop speed be set higher than 3 m/s, and lower than a speed for ink drops to dissociate (fail to merge), producing a satellite.

Thus, by setting the ink drop speed Vj of the ink drop that is discharged at the interval nearly equal to (n+1/2)×Tc after the preceding ink drop higher than 3 m/s, soiling of the nozzle and unstable operations due to poor discharge are prevented from occurring. In other words, the ink drop speed Vj tends to become low if the interval is set nearly equal to (n+1/2)×Tc, the low speed causing the nozzle to become soiled, and for this reason, a higher voltage is set, at which voltage the nozzle does not become soiled. Further, the voltage is set lower than a voltage at which a satellite is produced. In this manner, stable discharge of ink drops is obtained.

Figure 29:
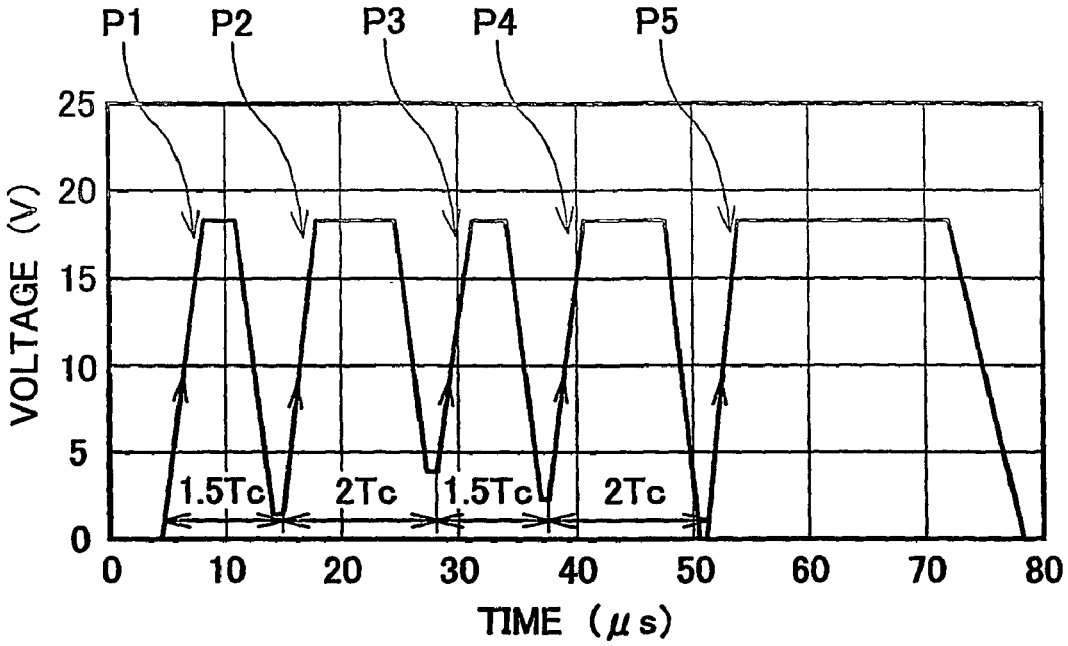
FIG. 29 graphs the drive signal according to the seventh embodiment of the present invention.

Next, the drive pulse of the seventh embodiment of the present invention is explained with reference to FIG. 29. The drive pulse according to the seventh embodiment contains the first through fifth drive pulses P1 through P5 for discharging the first ink drop through the fifth ink drop, respectively. The intervals between P1 and P2, and between P3 and P4 are set at 1.5 Tc; and the intervals between P2 and P3; and between P4 and P5 are set at 2 Tc.

Thus, five ink drops are discharged, wherein the second ink drop and the fourth ink drop are discharged at the interval 1.5 Tc after the respective preceding ink drops. The present invention is effective, especially when four or more ink drops are discharged and merged, including the above-mentioned embodiments.

Figure 40:
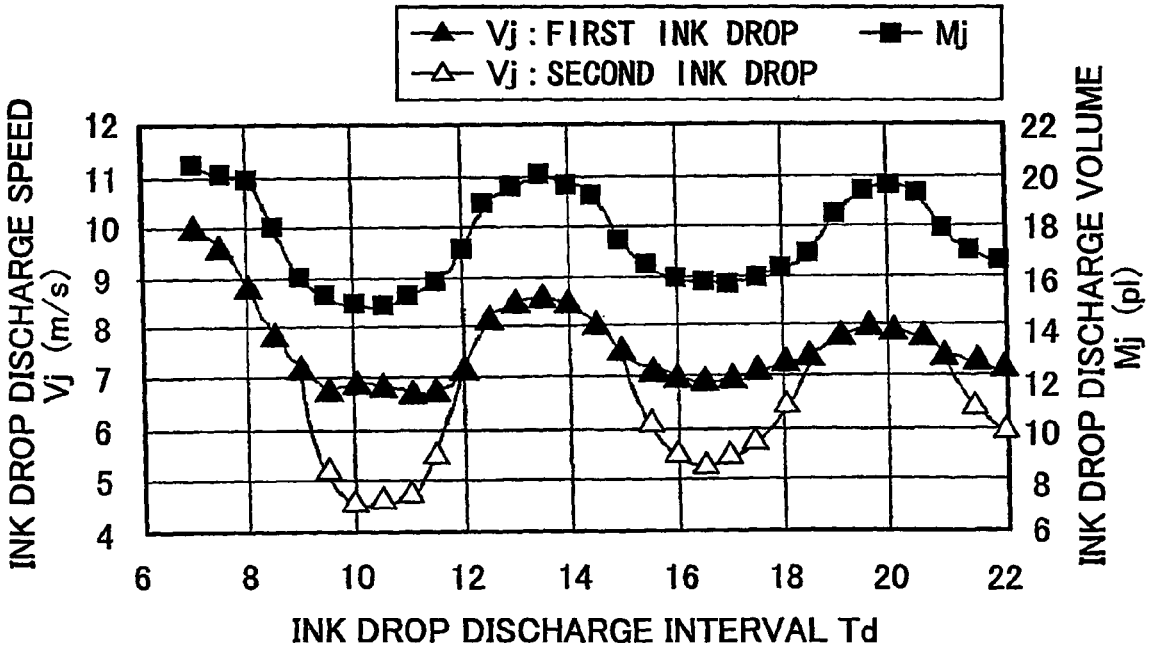
FIG. 40 graphs timing characteristics in the case of discharging two ink drops.

Further, the specific vibration cycle Tc of the pressurized ink chamber according to the embodiments of the present invention was about 6.5 μs, and in the case that ink drops are discharged at intervals of n×Tc, it is desirable that n=3 or greater, i.e., at 19.5 μs intervals at least. With reference to the conventional example as shown by FIG. 40, a peak is still present at about 20 μs intervals, the peaks being due to the influence of the residual pressure because of insufficient damping. However, this is better than repeatedly discharging ink drops at intervals of 2 Tc.

An example wherein three ink drops are discharged is considered. The third ink drop is made to start 2×19.5=39 μs after the first ink drop. Suppose that the speed of the first ink drop is set at 6 m/s. For the third ink drop to catch up to the first ink drop while traveling the 1 mm distance, a speed of 7.8 m/s is required. In the case of four ink drops, the fourth ink drop pursues after 3×19.5=58.5 μs, and the speed of the fourth ink drop has to be 9.2 m/s at least. In order to raise the speed, the pressure has to be raised, and the raised pressure narrows the margin for stable discharge due to the residual pressure vibration. In the case of five ink drops, the fifth ink drop starts flying 78 μs after the first ink drop, and the speed of the fifth ink drop has to be 11.3 m/s at least. Reliable and stable discharge at this speed is hard to achieve.

The seventh embodiment, containing 1.5 Tc intervals that have the vibration suppression effects, as described above solves this problem, where the fifth ink drop is discharged about 48.8 μs after the first ink drop successfully merging with the preceding ink drops without generating excessive pressure vibration.

Figure 30:
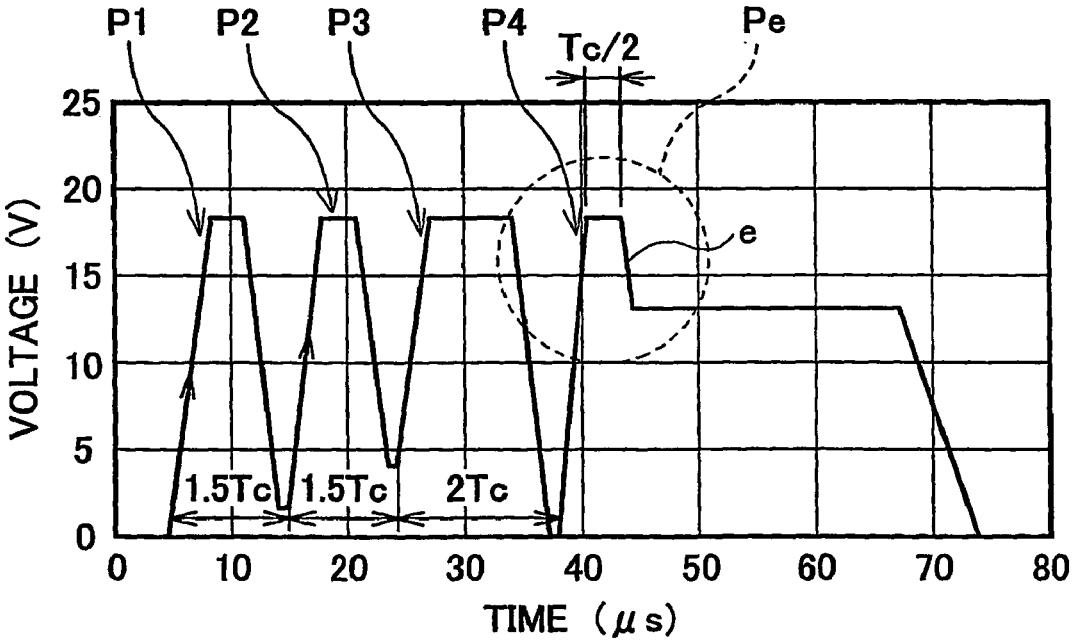
FIG. 30 graphs the drive signal according to the eighth embodiment of the present invention.

Next, the drive pulse of the eighth embodiment of the present invention is explained with reference to FIG. 30. The drive pulse according to the eighth embodiment contains a wave Pe having a wave element e for damping after discharge of the last ink drop, wherein the second ink drop is discharged at the 1.5 Tc interval.

The pressurized ink chamber 46 is contracted by the rising edge of Pe, the ink drop is discharged, the pressurized ink chamber 46 expands by the specific vibration, and after a period of about the Tc/2 interval the pressurized ink chamber 46 tends to be contracted by the specific vibration. At this moment, the wave element e for damping is applied to the pressurized ink chamber 46 such that the tendency of the pressurized ink chamber 46 to contract is counter-balanced by the expanding power of the wave element e. That is, when the pressurized ink chamber 46 contracts again, the wave element e expands the pressurized ink chamber 46. In this manner, the vibration of the pressurized ink chamber 46 is suppressed. That is, the wave element e carries out pressure damping of the last ink drop, the speed of which tends to be set high for merging.

As described above, by providing the discharge interval of Tc (n+1/2) cycle, and the damping wave element e within the Tc cycle just behind the last ink drop, the pressure vibration is suppressed, and stable ink drop discharge is carried out in a wide operational range.

Figure 31:
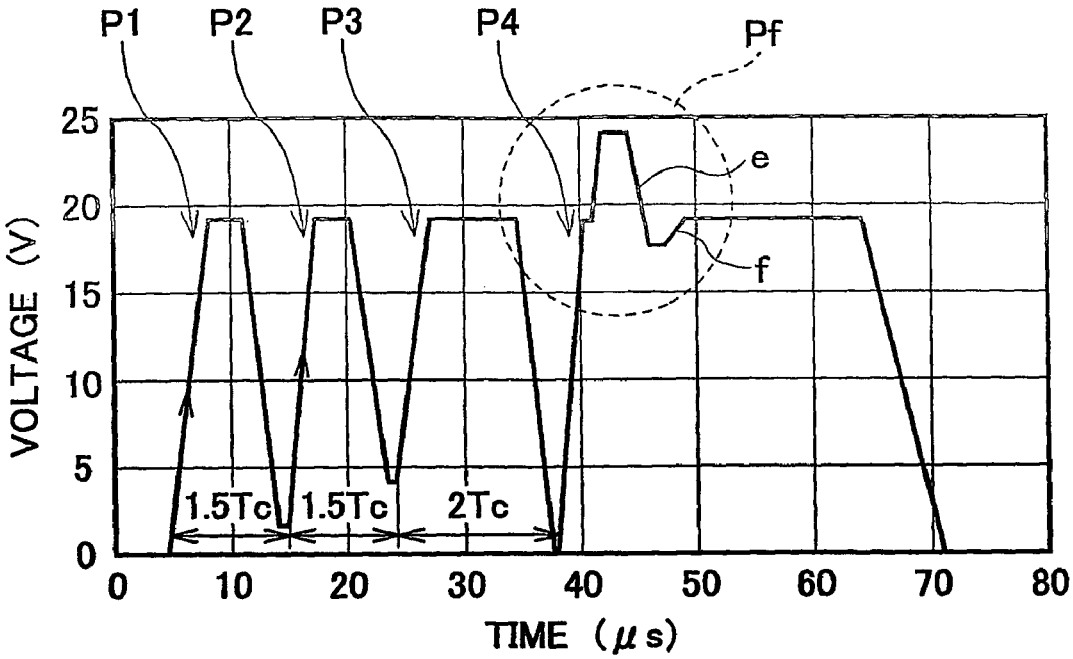
FIG. 31 graphs the drive signal according to the ninth embodiment of the present invention.
Figure 32:
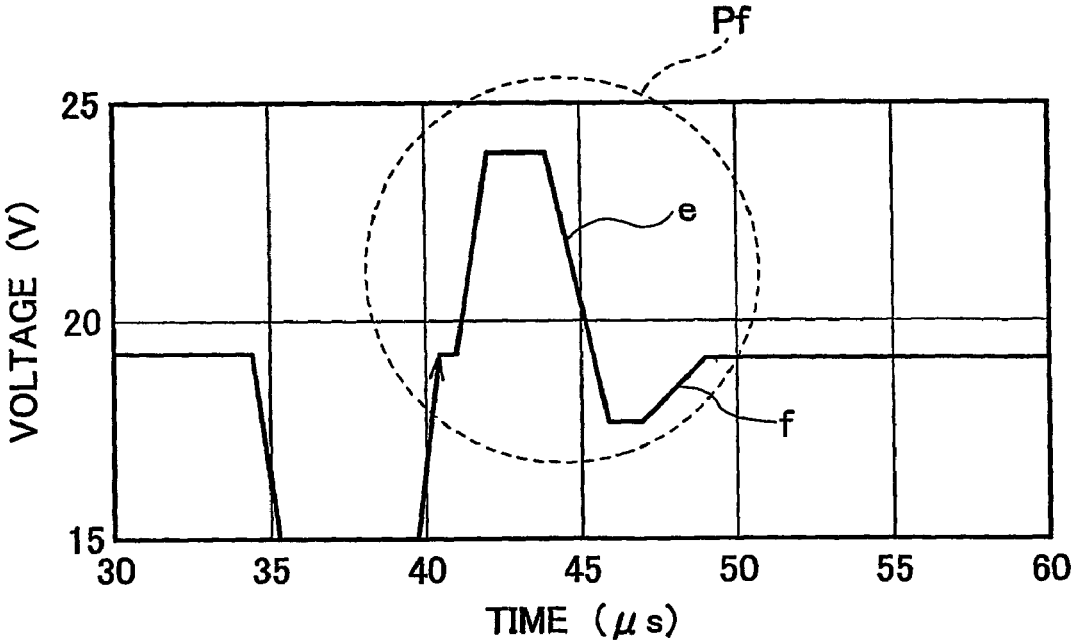
FIG. 32 is an expanded view of FIG. 31.

Next, the drive pulse of the ninth embodiment of the present invention is explained with reference to FIG. 31 and FIG. 32. Here, FIG. 32 is an expanded view of an area marked as Pf in FIG. 31. The drive pulse according to the ninth embodiment includes a waveform Pf that contains a wave element f for damping the residual pressure vibration within the Tc (the pressurized ink chamber specific vibration cycle) after the last ink drop discharge, in addition to the second ink drop being discharged at the 1.5 Tc interval, and the wave element e mentioned above being provided.

The damping drive within the interval Tc immediately after the discharge is highly effective in suppressing the pressure vibration due to the specific vibration cycle Tc as compared with usual damping. Specifically, the wave element f for damping is for contracting the pressurized ink chamber 46, and is applied to the pressurized ink chamber 46 when the pressurized ink chamber 46 tends to expand by the specific vibration after the pressurized ink chamber 46 is once contracted and discharges the ink drop. In this manner, the vibration of the pressurized ink chamber 46 is suppressed. This is effective for suppressing the pressure of the last ink drop that tends to be discharged at a high speed for merging.

As described above, by providing the discharge interval of Tc (n+1/2) cycle, and the damping wave element within the Tc cycle just behind the last ink drop, the pressure vibration is suppressed, and stable ink drop discharge is carried out in a wide operational range.

Next, gradation printing is explained with reference to FIGS. 33 through 38. Concerning the embodiments described above, descriptions are made as to how a large ink drop is formed by stably discharging two or more ink drops. Below, an example for performing gradation printing by switching a drive pulse within 1 printing cycle is explained.

Figure 33:
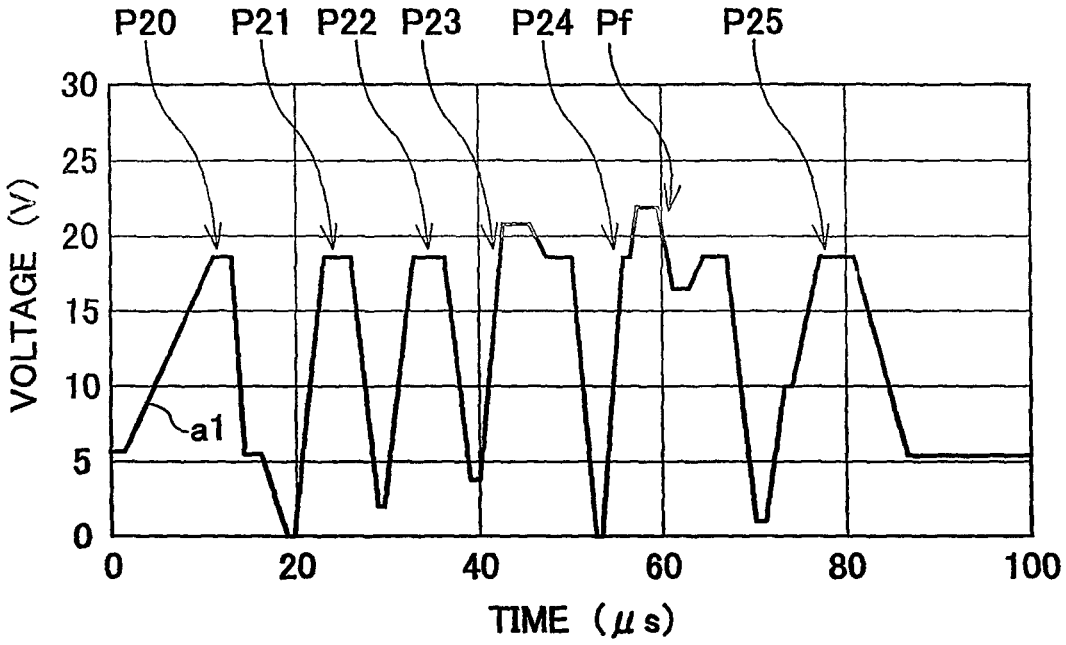
FIG. 33 graphs the drive pulse for explaining gradation recording.

First, the wave generation unit 91 (ref. FIG. 6) generates and outputs a drive pulse as shown in FIG. 33. The drive pulse includes six drive pulses P20 through P25, wherein the drive pulse P24 contains a pressure-suppression signal Pf that is provided within the specific vibration cycle Tc of the pressurized ink chamber 46.

Figure 34:
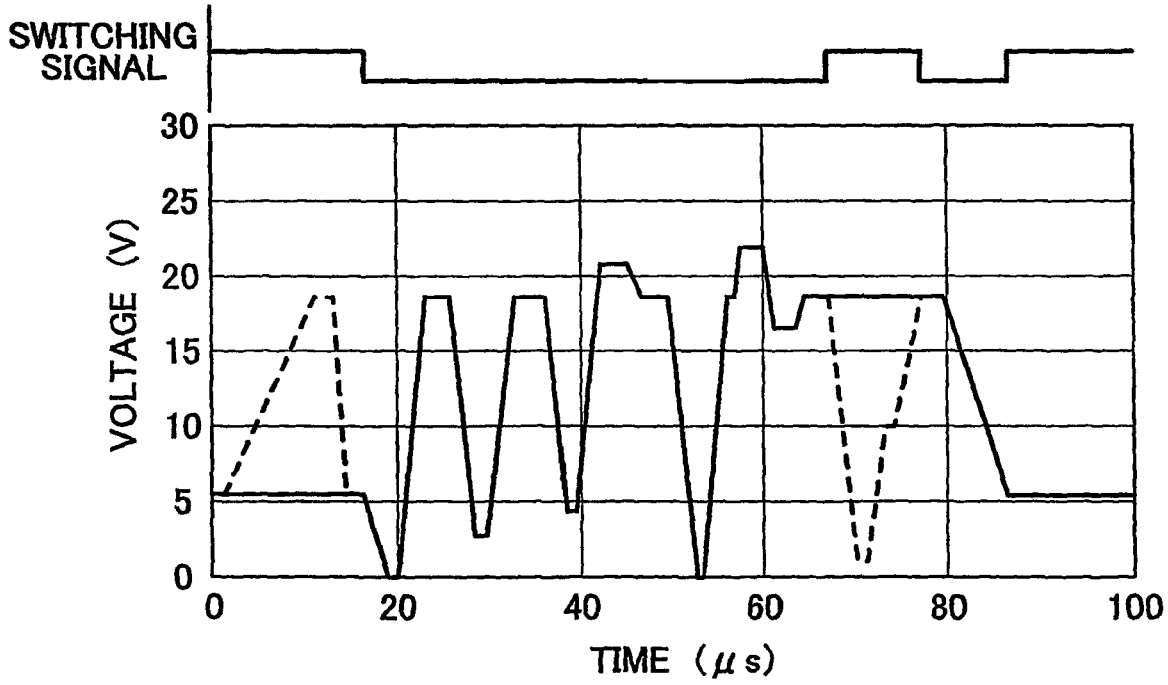
FIG. 34 graphs the drive pulse for forming a large ink drop.
Figure 35:
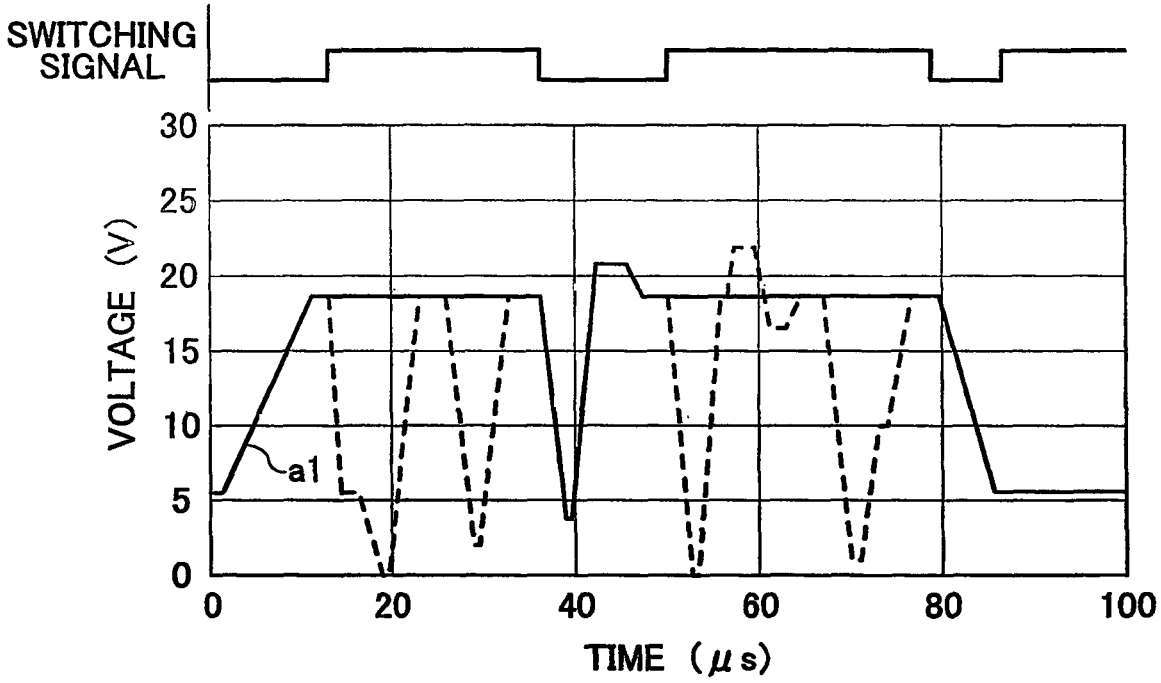
FIG. 35 graphs the drive pulse for forming a middle-sized ink drop.
Figure 36:
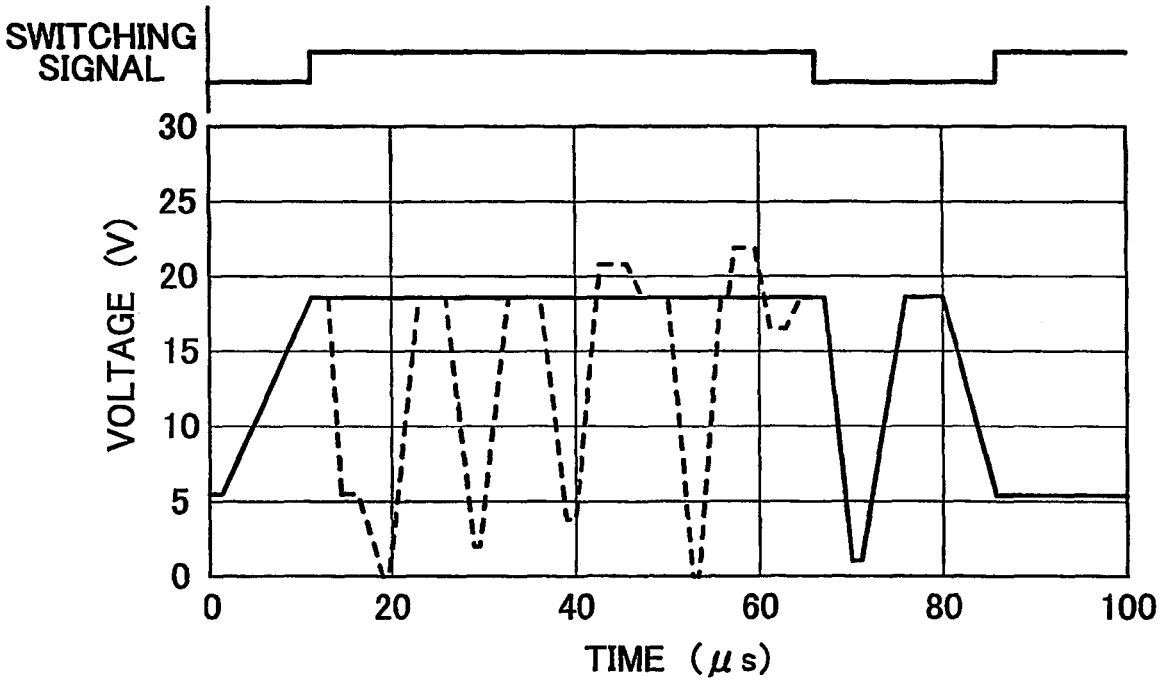
FIG. 36 graphs the drive pulse for forming a small ink drop.
Figure 37:
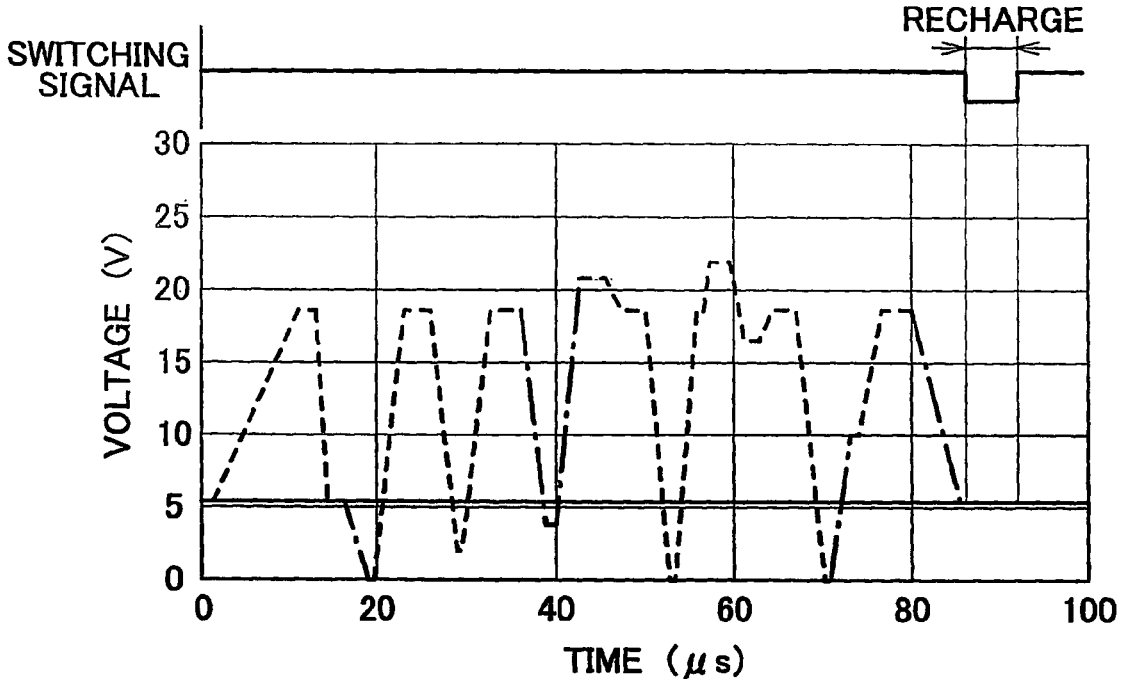
FIG. 37 graphs a voltage waveform applied to a non-discharging channel.

FIGS. 34 through 36 show drive pulses applied to the piezoelectric device for a large ink drop, a medium-sized ink drop, and a small-sized ink drop, respectively, corresponding to gradation data from the main control unit 73. Further, FIG. 37 shows the drive pulse when no printing is performed in a printing cycle.

Switching signals shown in FIGS. 34 through 37 indicate the timing of switching, but do not represent absolute voltage values. The switching signal is defined as "low is active", i.e., when the voltage of a switching signal is low, an analog switch ASm is turned on.

When forming a large ink drop, rising edges of the drive pulses P21 through P24 are used for discharging four ink drops as shown in FIG. 34. The interval between the first ink drop (discharged by the drive pulse P21) and the second ink drop (discharged by the drive pulse P22) is set to 1.5 Tc, and the interval between the second ink drop and the third ink drop (discharged by the drive pulse P23) is set to 1.5 Tc. As mentioned above, the pressure-suppression signal Pf is prepared within the Tc interval to P24 for the fourth ink drop.

This effect is the same as in the above-mentioned embodiments, that is, the resonance of the specific vibration cycle Tc is properly suppressed, and a large ink drop is stably formed.

FIG. 35 shows the waveform for forming a medium-sized ink drop, wherein the drive pulse P23 (the same as the third ink drop of the large ink drop) is used. Nevertheless, since it is necessary to raise the voltage by an inclination that does not cause ink discharge at the beginning of a printing cycle, the rising wave element al of the pulse P20 is used. Here, the inclination of the wave element al is set such that ink is not discharged.

FIG. 36 shows the drive signal for forming a small-sized ink drop, containing the drive pulse 25 that is not used when forming the large ink drop. Although a part of the drive pulse for forming the large ink drop can also be used, an independent wave element is used for forming the small-sized ink drop in this example.

Thus, according to the present invention, the time required for forming a large ink drop is shortened, which enables incorporating another wave without reducing the printing speed (i.e., without extending the printing cycle). Although selecting one or more drive pulses from a drive pulse sequence containing two or more drive pulses for forming two or more sizes of ink drops has been in practice, it is difficult for a printing cycle to contain a great number of drive pulses for forming different sizes of ink drops where high printing speed is required. The present invention solves this problem as described above.

With reference to FIG. 37, the switching signal for a non-printing cycle stays high such that an equi-potential level is provided (i.e., no pulses) except for the last stage of the printing cycle, where the switching signal shifts to low. This is for turning on the analog switch ASm, and for recharging the piezoelectric device such that charges leaked from the piezoelectric device are restored, and potential that may have varied is realigned. Although the recharging pulse is provided at the last of the drive pulses in this example, the recharging pulse can be provided at another place.

In this manner, when the piezoelectric device serves as the pressure generating means, the potential displacement by charge leaking from the piezoelectric device is prevented from occurring by providing a section where the switch means are made into the ON state. In this manner, reproducible operations and stable ink discharge are realized.

Figure 38:
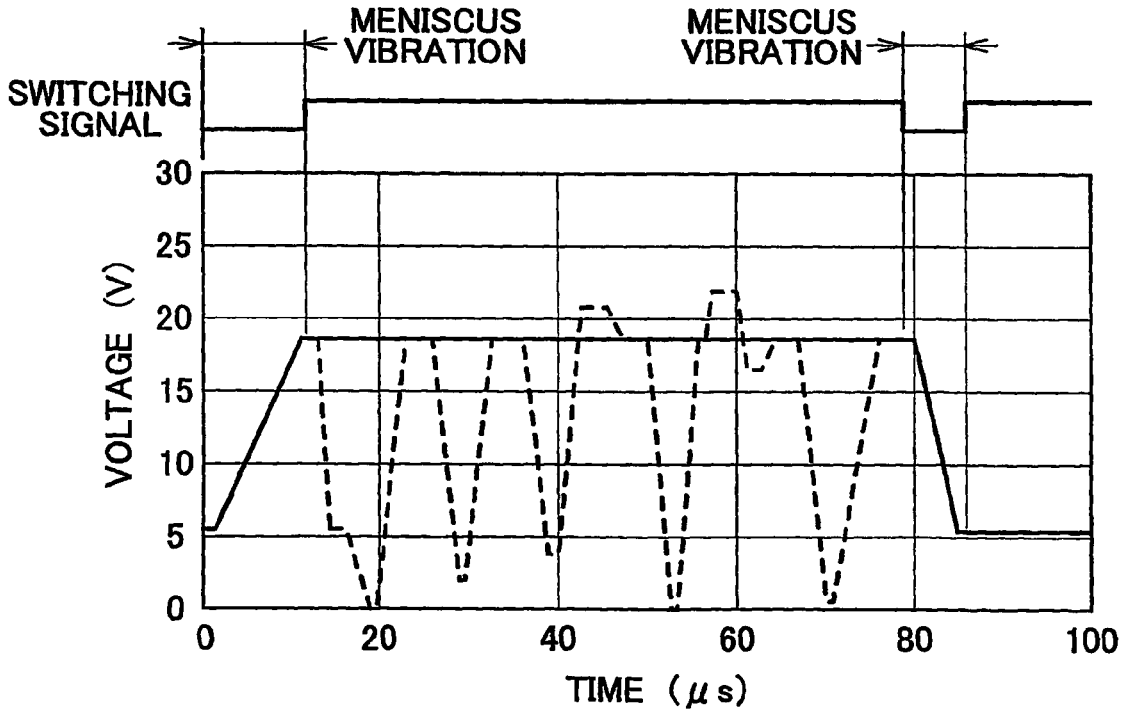
FIG. 38 graphs a voltage waveform for generating meniscus vibration applied to a non-discharging channel.
Figure 39:
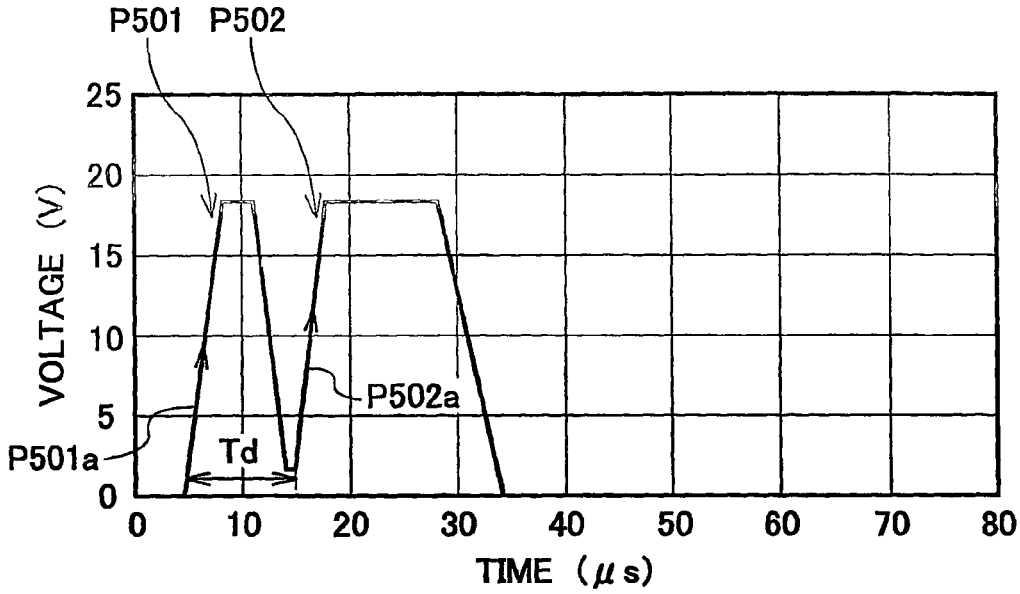
FIG. 39 graphs a voltage waveform for discharging two ink drops.

Further, the drive pulse for the non-printing cycle can take a form as shown in FIG. 38, wherein a voltage that does not cause an ink drop to be discharged is applied. This is for vibrating the meniscus of a non-printing channel such that ink dryness of the nozzle is prevented from occurring. Further, since the analog switch is turned on, charge that may have leaked can be restored. Furthermore, depending on the length of the wave, a recharging period can be prepared after raising the voltage and before dropping the voltage.

In the examples and exemplary embodiments described above, at least one ink drop other than the last ink drop is discharged at an interval nearly equal to (n+1/2)×Tc after the preceding ink drop. In this manner, the pressure vibration of the pressurized ink chamber is prevented from becoming excessive. The rule is not applied to the last ink drop such that a large ink drop can be formed. The ink drop volume Mj can range widely. Stable ink drop discharge is realized. As a result thereof, a high-definition image can be formed at high speed.

Further, the present invention is not limited to these examples and exemplary embodiments, but various variations and modifications may be made without departing from the scope of the present invention disclosure and the appended claims. For example, elements and/or features of different examples and illustrative embodiments may be combined with each other and/or substituted for each other within the scope of this disclosure and appended claims.

The present disclosure is based on Japanese Priority Application No. JPA 2003-183158 filed on Jun. 26, 2003, with the Japanese Patent Office, the entire contents of which are hereby incorporated herein by reference.

The invention claimed is:

1. An image formation apparatus for forming a relatively large ink drop by sequentially discharging a plurality of ink drops from an ink drop discharging head, the image formation apparatus comprising:

a pressure generating means being configured to generate pressure in an ink chamber to discharge ink drops in response to a drive pulse; and a drive pulse supplying means configured to supply drive pulses to the pressure generating means, the drive pulses being configured to cause the pressure generating means to:

contract a volume of the ink chamber without first expanding the volume of the ink chamber to discharge an ink drop, discharge a first ink drop at a first drop speed, discharge at least one intermediate ink drop other than an ink drop that is not followed by any more of the ink drops in a given printing cycle (a last ink drop) at an interval substantially equal to (n+1/2)×Tc but not equal to n×Tc and at an intermediate drop speed, discharge the last ink drop at an interval substantially equal to n×Tc but not equal to (n+1/2)×Tc and at a last drop speed, wherein the first drop speed is faster than the intermediate drop speed, the last drop speed is faster than the first drop speed and the intermediate drop speed, and the last ink drop gathers the at least one intermediate ink drop and subsequently merges with the first ink drop before reaching a print target medium to form the large ink drop, where n is an integer equal to or greater than 1, and Tc represents a resonance cycle of a pressurized ink chamber of the image formation apparatus, the interval being measured from when a corresponding preceding ink drop is discharged.

2. The image formation apparatus as claimed in claim 1, wherein the first ink drop is discharged by the pressurized ink chamber being contracted after being expanded, where a volume of contraction is greater than a volume of expansion, and where the volume of expansion may take a positive value or zero.

3. The image formation apparatus as claimed in claim 1, wherein a speed of one of the ink drops (the ink drop speed Vj) discharged at the interval substantially equal to (n+1/2)×Tc from the preceding ink drop is set at greater than three m/s, and at a speed at which the sequential ink drops are merged.

4. The image formation apparatus as claimed in claim 1, wherein four or more of the sequential ink drops merge during flight to form one of the relatively large ink drops.

5. The image formation apparatus as claimed in claim 1, wherein a waveform containing driving pulses for discharging the sequential ink drops includes a waveform for suppressing a residual vibration after a driving pulse for discharging the last ink drop.

6. The image formation apparatus as claimed in claim 1, wherein a medium-sized ink drop and a small-sized ink drop are each formed by selecting a part of driving pulses for forming the relatively large ink drop.

7. The image formation apparatus as claimed in claim 1, wherein the pressure generating means for generating the pressure for pressurizing the ink of the pressurized ink chamber is a piezoelectric device, a displacement direction of which is d33.

8. The image formation apparatus as claimed in claim 1, wherein at least one additional ink drop other than the at least one intermediate ink drop and the last drop is discharged at an interval substantially equal to n×Tc and not equal to (+1/2)×Tc.

9. The image formation apparatus as claimed in claim 1, wherein a predetermined interval between first and second ink drops of the sequential ink drops is substantially equal to 1.5×Tc such that the first and second ink drops merge before reaching a print target medium.

10. The image formation apparatus as claimed in claim 1, wherein the sequential ink drops are discharged when the pressure generating means contracts the pressurized ink chamber.

11. The image formation apparatus as claimed in claim 1, wherein the pressure generating means is configured to discharge the sequential ink drops such that the one or more of the sequential ink drops other than the last drop merge with the last drop in a reverse order from an order in which they were discharged.

12. The image formation apparatus as claimed in claim 2, wherein a second ink drop is discharged at an interval substantially equal to (n+1/2)×Tc from the first ink drop that precedes the second ink drop.

13. The image formation apparatus as claimed in claim 5, wherein the waveform for suppressing the residual vibration is provided within an elapsed time equivalent to Tc after the last ink drop is discharged.

14. The image formation apparatus as claimed in claim 6, wherein the driving pulses include a waveform for vibrating a meniscus without causing an ink drop to be discharged.

15. The image formation apparatus as claimed in claim 6, wherein the driving pulses include a section wherein a voltage is applied to the pressure generating means for pressurizing ink in the pressurized ink chamber.

16. The image formation apparatus as claimed in claim 7, wherein support sections of the piezoelectric device support partitions of the pressurized ink chamber.

17. The image formation apparatus as claimed in claim 15, wherein the pressure generating means is a piezoelectric device, and the piezoelectric device is recharged in the section wherein said voltage is applied.

18. An image formation apparatus for forming a relatively large ink drop by sequentially discharging a plurality of ink drops from an ink drop discharging head, the image formation apparatus comprising:

pressure generating means for discharging:

initial ink drops other than an ink drop that is not followed by any more of the ink drops in a given printing cycle (a last ink drop) at an interval substantially equal to $(n+1/2)\times Tc$ but not equal to $n\times Tc$, thereby suppressing a pressure vibration of a pressurized ink chamber of the image formation apparatus, and the last ink drop other than the one or more initial ink drops at an interval substantially equal to $n\times Tc$ in sync with a peak of the pressure vibration of the pressurized ink chamber but not equal to $(n+1/2)\times Tc$, wherein the last ink drop travels at a higher speed than the one or more initial ink drops and merges the one or more initial ink drops before reaching a print target medium to form the relatively large ink drop, where n is an integer equal to or greater than 1, and Tc represents a resonance cycle of the pressurized ink chamber, the interval being measured from when a corresponding preceding ink drop is discharged.

* * * * *